US008037660B2

(12) United States Patent
Lancaster, III et al.

(10) Patent No.: US 8,037,660 B2
(45) Date of Patent: Oct. 18, 2011

(54) METHOD FOR SECURING A LOAD TO A PALLET WITH A ROPED FILM WEB

(75) Inventors: Patrick R. Lancaster, III, Louisville, KY (US); David E. Eldridge, Fern Creek, KY (US); Willie Martin Hall, Taylorsville, KY (US); Richard L. Johnson, LaGrange, KY (US); Curtis W. Martin, Georgetown, KY (US); Philip R. Moore, Mount Washington, KY (US); Joseph Donald Norris, Pleasureville, KY (US)

(73) Assignee: Lantech.com, LLC, Louisville, KY (US)

( * ) Notice: Subject to any disclaimer, the term of this patent is extended or adjusted under 35 U.S.C. 154(b) by 0 days.

(21) Appl. No.: 11/709,879

(22) Filed: Feb. 23, 2007

(65) Prior Publication Data

US 2007/0209324 A1 Sep. 13, 2007

Related U.S. Application Data

(60) Provisional application No. 60/775,779, filed on Feb. 23, 2006.

(51) Int. Cl.
*B65B 11/04* (2006.01)
*B65B 11/02* (2006.01)

(52) U.S. Cl. ..... 53/399; 53/587; 53/588

(58) Field of Classification Search ..... 53/399, 53/441, 465, 556, 587–589, 211
See application file for complete search history.

(56) References Cited

U.S. PATENT DOCUMENTS

| | | | |
|---|---|---|---|
| 4,152,879 | A | 5/1979 | Shulman |
| 4,216,640 | A | 8/1980 | Kaufman |
| 4,235,062 | A | 11/1980 | Lancaster et al. |
| 4,271,657 | A | 6/1981 | Lancaster et al. |
| 4,300,326 | A | 11/1981 | Stackhouse |
| 4,387,548 | A | 6/1983 | Lancaster et al. |
| 4,395,255 | A | 7/1983 | Brancecky et al. |
| 4,418,510 | A | 12/1983 | Lancaster, III et al. |
| 4,432,185 | A | 2/1984 | Geisinger |
| 4,458,467 | A | 7/1984 | Shulman et al. |

(Continued)

FOREIGN PATENT DOCUMENTS

DE 36 34 924 A1 4/1988

(Continued)

OTHER PUBLICATIONS

International Search Report for PCT/US2004/000219, dated Jun. 21, 2004.

(Continued)

*Primary Examiner* — Stephen F Gerrity
(74) *Attorney, Agent, or Firm* — Wood, Herron & Evans, LLP

(57) ABSTRACT

An apparatus and method for wrapping a palletized load are provided. The apparatus preferably includes a film dispenser for dispensing a film web, at least one drive down roller configured to engage the width of the film web, and at least one roping mechanism. The at least one roping mechanism may be a cable rolling element configured to roll a portion of the film web into a rolled cable of film. The apparatus may also include an assembly for providing relative rotation between the load and the dispenser to wrap a roped portion of the film web around a base of the load/top portion of a pallet supporting the load.

3 Claims, 13 Drawing Sheets

U.S. PATENT DOCUMENTS

| | | | | |
|---|---|---|---|---|
| 4,501,105 | A | 2/1985 | Rogers et al. | |
| 4,503,658 | A | 3/1985 | Mouser et al. | |
| 4,514,955 | A | 5/1985 | Mouser et al. | |
| 4,590,746 | A | 5/1986 | Humphrey | |
| 4,676,048 | A | 6/1987 | Lancaster et al. | |
| 4,693,049 | A | 9/1987 | Humphrey | |
| 4,754,594 | A | 7/1988 | Lancaster | |
| 4,761,934 | A | 8/1988 | Lancaster | |
| 4,807,427 | A | 2/1989 | Casteel et al. | |
| 4,840,006 | A | 6/1989 | Humphrey | |
| 4,845,920 | A | 7/1989 | Lancaster | |
| 4,905,451 | A | 3/1990 | Jaconelli | |
| 4,953,336 | A | 9/1990 | Lancaster, III et al. | |
| 4,991,381 | A | 2/1991 | Simons | |
| 5,040,356 | A | 8/1991 | Thimon | |
| 5,040,359 | A | 8/1991 | Thimon | |
| 5,077,956 | A | 1/1992 | Thimon | |
| 5,107,657 | A * | 4/1992 | Diehl et al. | 53/556 |
| 5,186,981 | A | 2/1993 | Shellhamer et al. | |
| 5,195,296 | A | 3/1993 | Matsumoto | |
| 5,195,297 | A | 3/1993 | Lancaster et al. | |
| 5,195,301 | A | 3/1993 | Martin-Cocher et al. | |
| 5,203,136 | A * | 4/1993 | Thimon et al. | 53/399 |
| 5,203,139 | A | 4/1993 | Salsburg et al. | |
| 5,216,871 | A | 6/1993 | Hannen | |
| 5,240,198 | A | 8/1993 | Dorfel | |
| 5,301,493 | A | 4/1994 | Chen | |
| 5,311,725 | A | 5/1994 | Martin et al. | |
| 5,414,979 | A | 5/1995 | Moore et al. | |
| 5,447,008 | A | 9/1995 | Martin-Cocher | |
| 5,450,711 | A | 9/1995 | Martin-Cocher | |
| 5,463,842 | A | 11/1995 | Lancaster | |
| 5,572,855 | A | 11/1996 | Reigrut | |
| 5,765,344 | A | 6/1998 | Mandeville et al. | |
| 5,799,471 | A | 9/1998 | Chen | |
| 5,875,617 | A | 3/1999 | Scherer | |
| 5,884,453 | A | 3/1999 | Ramsey et al. | |
| 5,953,888 | A | 9/1999 | Martin-Cocher et al. | |
| 6,082,081 | A | 7/2000 | Mucha | |
| 6,195,968 | B1 * | 3/2001 | Marois et al. | 53/588 |
| 6,253,532 | B1 | 7/2001 | Orpen | |
| 6,293,074 | B1 | 9/2001 | Lancaster, III et al. | |
| 6,360,512 | B1 * | 3/2002 | Marois et al. | 53/399 |
| 6,453,643 | B1 | 9/2002 | Buscherini et al. | |
| 6,748,718 | B2 | 6/2004 | Lancaster, III et al. | |
| 6,826,893 | B2 | 12/2004 | Cere' | |
| 6,851,252 | B2 | 2/2005 | Mäki-Rahkola et al. | |
| 2003/0110737 | A1 | 6/2003 | Lancaster, III et al. | |
| 2003/0145563 | A1 | 8/2003 | Cere' | |
| 2005/0044812 | A1 | 3/2005 | Lancaster, III et al. | |
| 2006/0213155 | A1 | 9/2006 | Forni et al. | |
| 2006/0248858 | A1 | 11/2006 | Lancaster, III et al. | |
| 2006/0254225 | A1 | 11/2006 | Lancaster, III et al. | |
| 2006/0289691 | A1 | 12/2006 | Forni | |
| 2007/0204564 | A1 | 9/2007 | Lancaster, III et al. | |
| 2007/0204565 | A1 | 9/2007 | Lancaster, III et al. | |
| 2007/0209324 | A1 | 9/2007 | Lancaster, III et al. | |

FOREIGN PATENT DOCUMENTS

| | | | |
|---|---|---|---|
| EP | 0096635 | B1 | 12/1983 |
| EP | 0 466 980 | A1 | 1/1992 |
| EP | 0 811 554 | A1 | 10/1997 |
| EP | 1 213 223 | A1 | 6/2002 |
| EP | 1 705 119 | A1 | 9/2006 |
| EP | 1 717 149 | A1 | 11/2006 |
| EP | 1 736 426 | A2 | 12/2006 |
| EP | 1 736 426 | A3 | 10/2007 |
| GB | 2107668 | A | 5/1983 |
| WO | WO 98/22346 | A | 5/1998 |
| WO | WO 2004/069659 | A1 | 8/2004 |
| WO | WO 2006/110596 | A1 | 10/2006 |
| WO | WO 2007/071593 | A1 | 6/2007 |
| WO | WO 2007/100597 | A2 | 9/2007 |

OTHER PUBLICATIONS

International Search Report for PCT/US2006/013178, dated Aug. 14, 2006.

International Search Report for PCT/US2007/004589, dated Sep. 9, 2007.

* cited by examiner

METHOD FOR SECURING A LOAD TO A PALLET WITH A ROPED FILM WEB

This application claims priority under 35 U.S.C. §119 based on U.S. Provisional Application No. 60/775,779, filed Feb. 23, 2006, the complete disclosure of which is incorporated herein by reference.

FIELD OF THE INVENTION

The present invention relates to wrapping a bottom portion of a palletized load with a conventional rope of packaging material. The present invention also relates to rolling a portion of a packaging material web into a rolled cable to be wrapped around a load. The present invention further relates to wrapping a palletized load with packaging material, and more particularly, securing a bottom portion of the wrapped load, in contact with a pallet, with the rolled cable of packaging material.

BACKGROUND OF THE INVENTION

Various packaging techniques have been used to build a load of unit products and subsequently wrap them for transportation, storage, containment and stabilization, protection and waterproofing. Products are often stacked as a load on a pallet to simplify handling of the products. The pallet load is commonly wrapped with stretch wrap packaging material. One system uses stretch wrapping machines to stretch, dispense and wrap stretch packaging material around a load. Stretch wrapping can be performed as an inline, automated packaging technique that dispenses and wraps packaging material in a stretch condition around a load on a pallet to cover and contain the load. Pallet stretch wrapping, whether accomplished by a turntable, rotating arm, or vertical rotating ring, typically covers the four vertical sides of the load with a stretchable film such as polyethylene film. In each of these arrangements, relative rotation is provided between the load and the packaging material dispenser to wrap packaging material about the sides of the load.

Stretch wrapping machines provide relative rotation between a stretch wrap packaging dispenser and a load either by driving the stretch wrap packaging dispenser around a stationary load or rotating the load on a turntable. Upon relative rotation, packaging material is wrapped on the load. Ring style stretch wrappers generally include a roll of packaging material mounted in a dispenser that rotates about the load on a ring. Vertical rings move substantially vertically between an upper and lower position to wrap film around a load. In a vertical ring, as in turntable and rotating wrap arm apparatuses, the four vertical sides of the load are wrapped, along the height of the load.

When pallet loads are wrapped, it is beneficial to wrap the film around the base of the load and at least a top portion of the pallet supporting the load in order to secure the load to the pallet. If the film is not wrapped around enough of the pallet, shifting of the load may occur during transportation of the load. In addition, it is also desirable to form a conventional rope of film at the base of the film web before applying it to the base of the load and the top portion of the pallet to provide additional resistance to load shifting. In order to form the conventional rope of film at the base of the load and wrap the base of the load and the pallet, the packaging material must be dispensed at a level below the base of the load.

In general, a packaging material dispenser supports a roll of packaging material a couple of inches above its base. In addition, the packaging material typically necks down one to two inches on both its top and bottom edges. Furthermore, one to two inches of clearance are required between the base of the packaging material dispenser and a load support surface (e.g., pedestal, conveyor, or floor) supporting the pallet and the load. Thus, in conventional stretch wrapping apparatuses, the lower edge of the packaging material is typically six to seven inches above the base of the pallet. Since most pallets are five to eight inches tall, there may be very little packaging material securing the load to the pallet.

To dispense the packaging material and create a rope at a level below the base of the load, the packaging material dispenser must be lowered sufficiently below the load such that the base of the roll of packaging material to be dispensed is below the base of the load. Certain types of stretch wrapping apparatuses, such as conventional turntable style machines, support palletized loads well above floor level, thereby providing sufficient clearance to lower the packaging material dispenser, and the base of the roll of packaging material, below the base of the load so that the packaging material can be applied to the pallet and the base of the load.

Other types of machines, such as overhead machines and low profile turntable machines, do not provide the clearance necessary to lower the packaging material dispenser below the base of the load. In overhead machines, a rotating arm that supports the packaging material dispenser must be able to clear the load support surface (e.g., pedestal, conveyor, or floor). In low profile machines, the top of a rotatable turntable is only a couple of inches above the floor, and there is not enough clearance for the packaging material dispenser, and thus the base of the roll of packaging material, to be lowered below the level of the base of the load. In machines such as these, it is necessary to drive the packaging material and the rope of packaging material to a level below the top of the pallet supporting the load.

Various techniques have been used in overhead machines in attempts to overcome this problem. Some prior art devices have tilted the packaging material dispenser, while others have tilted one or more idle rollers. See, for example, U.S. Pat. No. 5,875,617. Tilting the packaging material dispenser and/or idle rollers has had limited success in working the packaging material downward onto the pallet. Tilted roller concepts have had marginal success only, due to the sensitive nature of the tracking technique. For example, if the roller is tilted too far, the packaging material collapses into a total rope, and if the roller is not tilted far enough, the packaging material does not move downward enough to sufficiently cover the pallet. In addition, variation in packaging material surface, temperature, and wrap force make it difficult to maintain an angle that will lower the packaging sufficiently without narrowing it so much that many additional layers of wrap are required, decreasing wrap efficiency and increasing wrap cycle cost. Additionally If the film is successfully driven down below the last roller, the film will snag on the roller supporting mechanism and cause a film break.

Angled bars have also been used in an attempt to guide packaging material to a level below the base of the load. See, for example, U.S. Pat. No. 5,077,956. This technique has had little success due to the high forces incurred during stretch wrapping. The resultant friction is problematic in maintaining a constant wrap force and consistent packaging material guiding. Without complex and costly film feed force controls, friction build-up due to the tilted bars would break the packaging material when added to the friction normally experienced during stretch wrapping.

Other prior art techniques include "dropping down" a conveyor around a palletized load to leave the palletized load on a pedestal, providing sufficient clearance to lower the packaging material dispenser, including the bottom of the roll or packaging material, below the level of the base of the load. Alternatively, some conveyor designs "pop up" the palletized load, raising it sufficiently above the conveyor to provide clearance for lowering the packaging material dispenser, including the base of the roll of packaging material, below the level of the base of the load. These are complex mechanical systems that are costly to maintain.

A conventional rope of packaging material is created when the base or bottom portion of the packaging material is moved over a conventional roping mechanism, such as a wheel or fixed horizontal bar. The conventional roping mechanism pushes the base or bottom portion of the packaging material upward into itself, gathering the base or bottom portion of the packaging material into a structure commonly referred to as a conventional rope of packaging material. As discussed above, the conventional rope may be wrapped around the base of the load to secure the packaging material layers to the load, thereby improving load containment. In conventional ropes, the bottom portion of the packaging material is gathered, i.e., pushed together in accordion-like fashion. Only the packaging material's tackiness holds the gathered packaging material together, and thus, a conventional rope does not have any structural integrity. Thus, it is common for portions of a conventional rope of film to come undone or loosen during or after the wrapping process. For this reason, there is a need for a rope structure that is capable of retaining its structural integrity during the wrapping process and after the wrapping process, when the load is subject to various forces during shipping.

It is accordingly a primary object of the invention to provide a method and apparatus for rolling packaging material into a rolled cable before applying it to the base of a load and the top portion of a pallet to further secure the load to the pallet.

It is an additional object of the present invention to provide a method and apparatus to reduce the complexity and cost associated with rolling a portion of a web of film into a rolled cable.

SUMMARY OF THE INVENTION

In accordance with the invention, an apparatus for wrapping a load is provided. The apparatus includes a dispenser for dispensing a film web. The apparatus also includes a first drive down roller positioned to continuously engage at least a portion of a width of the film web in a film path from the dispenser to the load. The first drive down roller is selectively moveable between a substantially vertical position and a tilted film drive down position. The apparatus also includes at least one roping element positioned upstream of the first drive down roller.

According to another aspect of the present invention, a method for wrapping a load is provided. The method includes dispensing a film web from a film dispenser. The method also includes providing relative rotation between the load and the dispenser to wrap the film web around the load, and continuously engaging the film web in a film path between the dispenser and the load with at least one drive down roller. The method further includes rolling a portion of the film web into a rolled cable of film, and selectively driving down a portion of the film web in the film path with the at least one drive down roller.

According to yet another aspect of the present invention, a method for wrapping a load is provided. The method includes dispensing a film web from a film dispenser. The method also includes, during substantially an entire wrap cycle, continuously engaging at least a portion of the film web with a cable rolling element to roll the portion of the film web into a rolled cable of film. The method further includes providing relative rotation and relative vertical movement between the load and the dispenser to wrap the film web and the rolled cable of film spirally around the load.

According to yet another aspect of the present invention, a method for wrapping a load is provided. The method includes dispensing a film web from a film dispenser. The method also includes, during substantially an entire wrap cycle, continuously engaging at least a portion of the film web with a cable rolling element to roll the portion of the film web into rolled cable of film. The method further includes providing relative rotation and relative vertical movement between the load and the dispenser to wrap the film web and the rolled cable of film spirally and around the load, and selectively driving down a portion of the film web in the film path with at least one drive down roller.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present embodiments of the invention, examples of which are illustrated in the accompanying drawings. Wherever possible, the same reference numbers will be used throughout the drawings to refer to the same or like parts.

The apparatus and method of the present invention direct a film web that moves from a film roll through a dispenser including a plurality of rollers to a desired position such that a bottom portion of the film web is at an elevation below a top portion of a pallet supporting a load to be wrapped. This permits the base of the load and the top of the pallet to be wrapped with the film, better securing the load to the pallet and reducing the potential for load shifting during transport. At least a part of the bottom portion of the film web positioned below the top of the pallet may be formed into a rope structure. The rope structure is wrapped around the pallet to secure the load to the pallet. The rope structure is a portion of the web of film that is concentrated in a tightly compacted, and preferably somewhat round, shape. The rope structure may be a conventional rope of film, which is gathered, compacted or compressed; or a rolled cable of film, which is described below.

Figure 11:
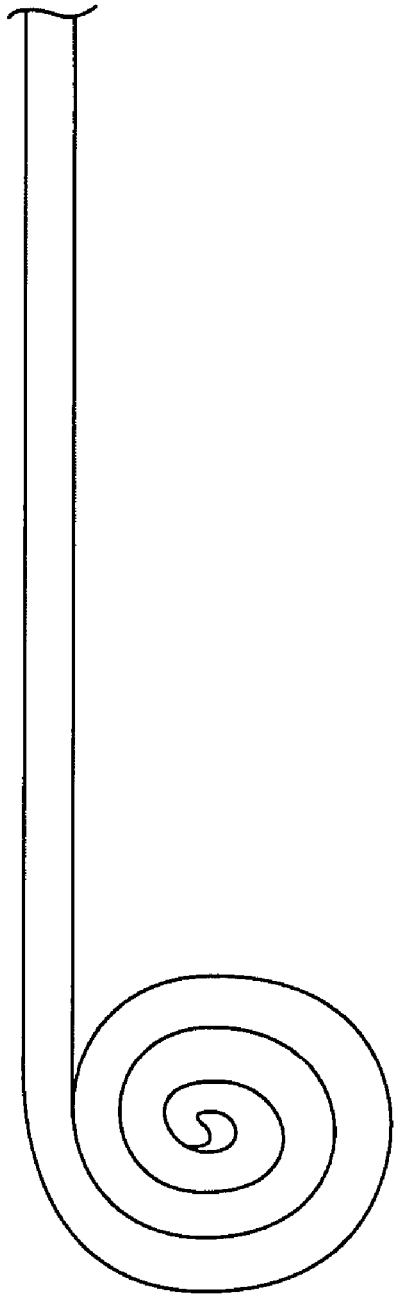
FIG. 11 is a cross-sectional view of a rolled cable of film, according to an aspect of the invention.

The present invention also provides a method and an apparatus for creating a rolled cable of film that is capable of maintaining its structural integrity as a rope structure during and after wrapping. The apparatus and method of the present invention roll an outer edge of either a top or bottom of the film web inward upon itself and toward the center of the film web. The film is rolled upon itself to form a tightly rolled cable of film. As used herein, the term "roll" means to wrap the film web round and round upon itself, for example, in the manner a poster is rolled up. The rolled cable of film has a preferred cross-section as shown in FIG. 11. Thus, for example, the bottom edge of the film web may be rolled upward upon itself and toward the center of the film web to form the rolled cable of film, or the top edge of the film web may be rolled downward upon itself toward the center of the film web to form the rolled cable of film. The film rolls tightly against itself, forming a high tensile rolled cable. It is possible, however, that a small portion of the edge of the film web may be gathered together prior to the film rolling up on itself. Preferably, the rolled cable includes three to five inches of the film from an outer edge of the film web.

The conventional rope of film is substantially stronger than the web of film. A rolled cable of film is also substantially stronger than the web of film and in comparison to the conventional rope of film, has the added benefit of structural integrity. The conventional rope and the rolled cable of film, when wrapped around the pallet, serve to anchor the web of film wrapped around the load and the pallet in substantially the same manner as a piece of wire wrapped around the pallet and over the film. This serves to prevent the film wrapped around the load from being pulled up and away from the pallet.

Because the conventional rope and the rolled cable of film can be wrapped around the pallet and not the load, it is possible to apply both the conventional rope and the rolled cable at a higher wrap force. The conventional rope is less susceptible to damage than non-roped film, and the rolled cable is less susceptible to damage than the conventional rope of film. Use of either the conventional rope of film or the rolled cable of film thus makes the wrapping of the load more robust. That is, the wrapped load is better able to withstand forces applied to it if it rubs against the pallet, or if the pallet rubs against another structure during shipping, such as a side of a truck or another pallet.

In addition, both the conventional rope and the rolled cable of film have the benefit of exerting a reactive force against anything pulling on it. For example, if something pulls the conventional rope or rolled cable away from the load on one side of the load, the load will not automatically shift because both the conventional rope and the rolled cable on the other side of the pallet will pull back, reacting to the force and counteracting the force to stabilize the load.

Inventors' testing has shown that use of the film web with a rolled cable of film on a bottom portion of the film web provides superior results over standard film wrapping. Loads wrapped with the rolled cable around the top of the pallet, above the fork holes, were tilted with the pallet or lifted "off" the pallet. In each case, the film web maintained contact between the load and the pallet.

Another advantage of the rolled cable of film is that it may be used, for example as a bottom portion of the film web, and carried throughout the wrapping process. In such an embodiment, the rolled cable of film may act as a "rip stop." That is, the rolled cable of film may prevent tearing or breaking of the film at weakened portions of the film web during the wrapping process due to the integrity of the rolled cable of film.

The present application makes reference to several different types of rollers used in the film dispenser, a pre-stretch portion of the film dispenser, a film drive down portion, and other various rollers that serve various purposes. Thus, the following explanation of the different types of rollers disclosed herein is provided. As used herein the term "drive down roller" refers to a roller that may be tilted from a relatively substantially vertical position to a film drive down position. In the film drive down position, film will engage the surface of the drive down roller at a first elevation, but due to the tilted position of the drive down roller in this position, the film will be driven down along a length of the drive down roller as it travels around the circumference of the drive down roller, exiting the drive down roller steered at an angle downward from horizontal at a lower elevation than where it engaged the drive down roller. The term "pre-stretch roller" refers to a powered or unpowered, driven roller found in a pre-stretch assembly of a packaging material dispenser. Pre-stretch rollers may be used to stretch film before it is dispensed to a load. Pre-stretch rollers are generally oriented along their longitudinal axes. The term "idle roller" refers to non-powered non-driven rollers used for a variety of purposes. For example, an uncoated idle roller may be used with a pre-stretch roller to provide a pinching action on the pre-stretch roller. A coated idle roller may be used with a cable rolling element to roll film into a rolled cable by placing the cable rolling element in close juxtaposition with a downstream side of the coated idle roller. Idle rollers are also generally oriented along their longitudinal axes. The cable rolling element may include a horizontally oriented roller having a V-shaped groove on its circumference. A conventional roping element may include a horizontally oriented roller placed upstream from a drive down roller.

According to one aspect of the present disclosure, a stretch wrapping apparatus 1 is provided. As embodied herein and shown in FIG. 1, the stretch wrapping apparatus 1 may include a packaging material dispenser 10 to dispense a sheet of film 12 in a web form. The packaging material dispenser 10 may include a roll carriage 14. As embodied herein and shown in FIGS. 1 and 2, the roll carriage 14 may include a lower support plate 16 and an upper support plate 18 configured to hold a roll 20 of packaging material therebetween. Preferably, the packaging material dispenser 10 may be lightweight, which may allow for faster movement of the packaging material dispenser 10 relative to the load, thus requiring less energy consumption, and permitting faster wrapping cycles and increased efficiency.

In an exemplary embodiment, the film web 12 may be stretch wrap packaging material. However, it should be understood that various other packaging materials such as netting, strapping, banding, or tape may be used as well. As used herein, the terms "packaging material," "web," "film," "film web," and "packaging material web" may be used interchangeably.

The packaging material dispenser 10 may include a pre-stretch assembly 22. The pre-stretch assembly 22 may include an upstream pre-stretch roller 24 and a downstream pre-stretch roller 26. "Upstream" and "downstream," as used in this application, are intended to define the direction of movement relative to the flow of film 12 from the packaging material dispenser 10. Thus, since the film 12 flows from the packaging material dispenser 10, movement toward the packaging material dispenser 10 and against the flow of film 12 from the packaging material dispenser 10 may be defined as "upstream" and movement away from the packaging material dispenser 10 and with the flow of film 12 from the packaging material dispenser 10 may be defined as "downstream."

The upstream and downstream pre-stretch rollers 24 and 26 may include packaging material engaging surfaces that are either coated or uncoated depending on the application in which the upstream and downstream pre-stretch rollers 24 and 26 are used. The surface movement of the upstream pre-stretch roller 24 may be at least 40% slower than that of the downstream pre-stretch roller 26. For example, the surface movement of the upstream pre-stretch roller 24 can be about 40%, 75%, 200% or 300% slower than the surface movement of the downstream pre-stretch roller 26 to obtain pre-stretching of 40%, 75%, 200% or 300%. While stretching normally ranges from 40 to 300%, excellent results have been obtained when narrower ranges of pre-stretching are required, such as stretching the material 40% to 75%, 75% to 200%, 200% to 300%, and at least 100%. In certain instances, pre-stretching has been successful at over 300% of stretch. The upstream and downstream pre-stretch rollers 24 and 26 may be operatively connected by a drive chain, belt, or any other suitable connection to maintain their relative rate of rotation and thus provide the desired percentage of pre-stretch.

Rapid elongation of the film web 12 by the pre-stretch rollers 24 and 26, followed by rapid strain relief of the film web 12, may cause a "memorization" effect. Due to this "memorization" effect, the film web 12 may actually continue to shrink for some time after being wrapped onto a load. Over time, the film web 12 may significantly increase holding force and conformation to the load. This characteristic of the film web 12 may allow it to be used for wrapping loads at very close to zero stretch wrapping force, using the memory to build containment force and load conformity.

Figure 1:
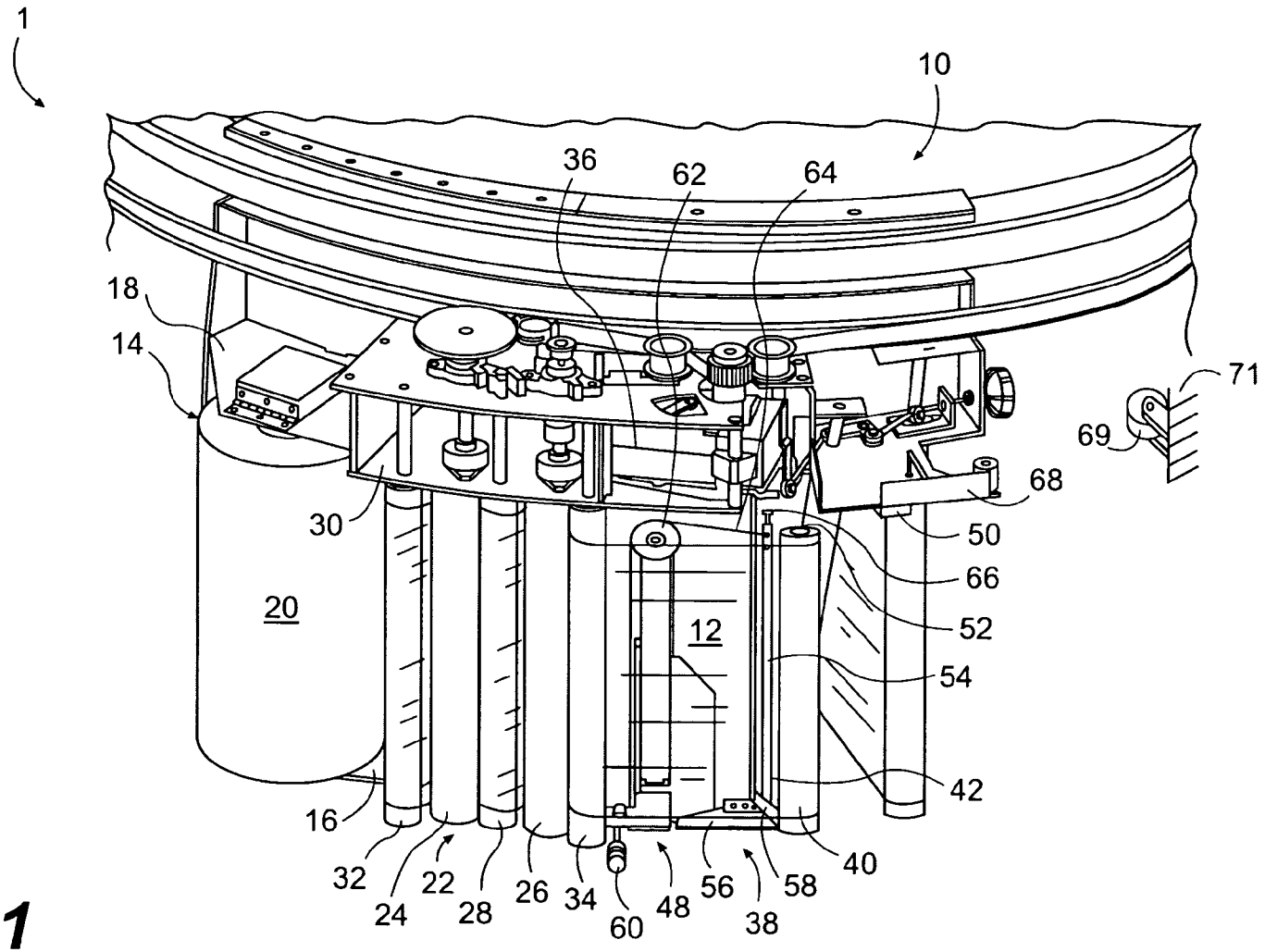
FIG. 1 is an isometric view of a packaging material dispenser of a wrapping apparatus, with a drive down roller in a first substantially vertical position, according to an aspect of the invention.
Figure 2:
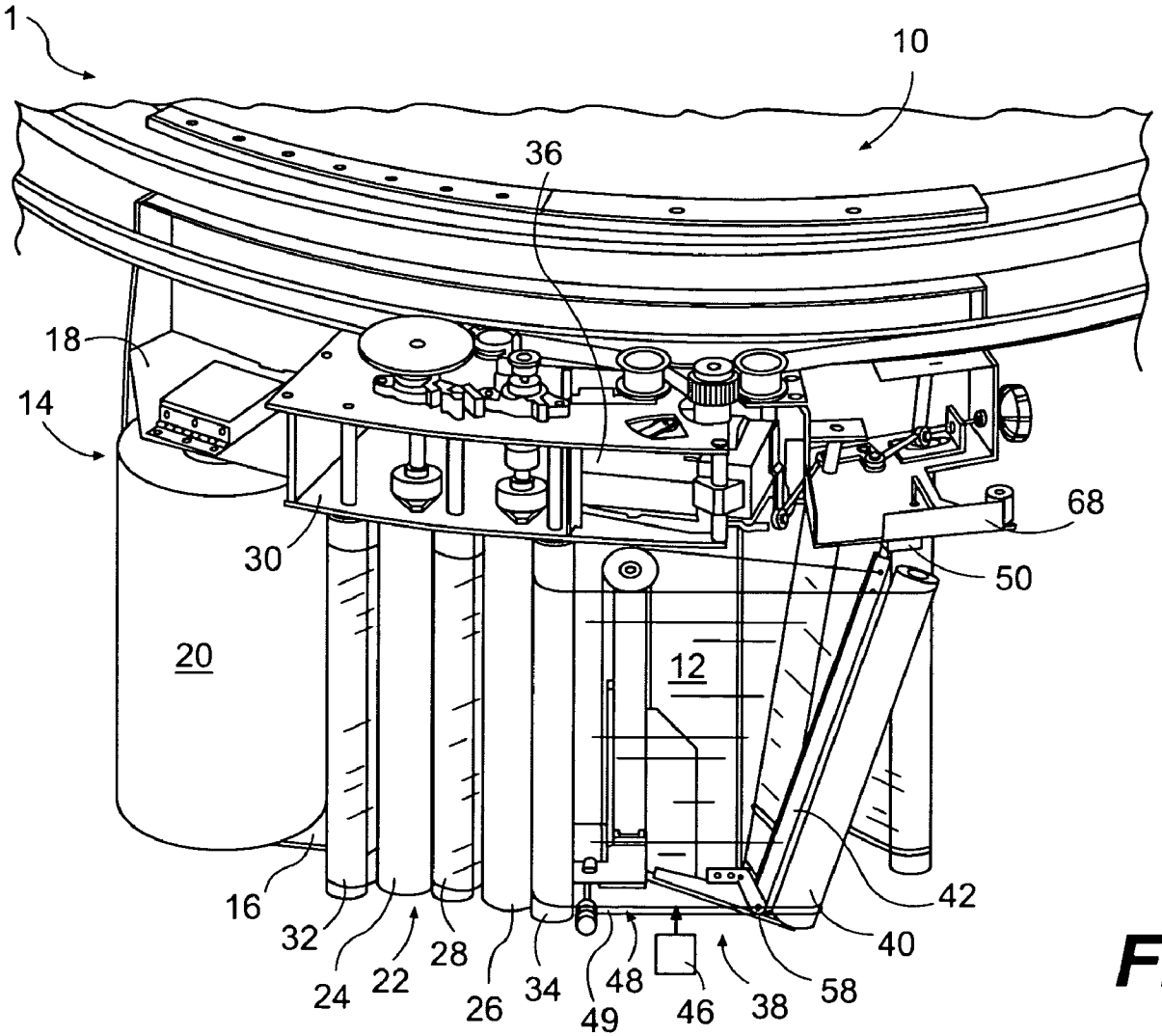
FIG. 2 is an isometric view of the packaging material dispenser of FIG. 1, with the drive down roller in a second tilted position, according to one aspect of the invention.

As embodied herein and shown in FIGS. 1 and 2, the pre-stretch assembly 22 may also include a midstream pre-stretch idle roller 28 positionable between the upstream and downstream pre-stretch rollers 24 and 26. The midstream pre-stretch idle roller 28 may be the same diameter as or smaller in diameter than the upstream and downstream pre-stretch rollers 24 and 26. Preferably, the midstream pre-stretch idle roller 28 is uncoated. In one exemplary embodiment, the midstream pre-stretch idle roller 28 may include an uncoated idle roller operatively connected to an upper frame portion 30 of the packaging material dispenser 10. The midstream pre-stretch idle roller 28 may also be a cantilevered midstream pre-stretch idle roller that is unconnected to any additional structure and may be unsupported at its base. Preferably the midstream pre-stretch idle roller 28 may be aligned to provide a pinching action on the upstream pre-stretch roller 24, as disclosed in U.S. Pat. No. 5,414,979, the entire disclosure of which is incorporated herein by reference.

According to another aspect of the present invention, the packaging material dispenser 10 may include an upstream pre-stretch idle roller 32, positioned upstream of the upstream pre-stretch roller 24. The packaging material dispenser 10 may also include a downstream pre-stretch idle roller 34 positioned downstream of the downstream pre-stretch roller 26. The upstream and downstream pre-stretch idle rollers 32 and 34 may be structured similarly to the midstream pre-stretch idle roller 28, and may perform a similar function. The longitudinal axes of upstream, midstream, and downstream pre-stretch idle rollers 28, 32, and 34 may be substantially parallel to that of the upstream and downstream pre-stretch rollers 24 and 26.

As shown in FIGS. 1 and 2, the packaging material dispenser 10 may also include a mechanical power transmission 36 that may provide power for rotating the upstream and downstream pre-stretch rollers 24 and 26. A leading end of the film web 12 may be threaded through the upstream and downstream pre-stretch rollers 24 and 26, and through upstream, midstream, and downstream pre-stretch idle rollers 28, 32, and 34, of the pre-stretch assembly 22. Then, the leading end of the film web 12 may be wrapped around a film drive down assembly 38 mounted on the packaging material dispenser 10. The film drive down assembly 38 includes means for forming at least a portion of the film web 12 into either a conventional rope or a rolled cable of film 49 to help secure a load on a pallet. The term "rope" may broadly encompass both conventional ropes and rolled cables.

As shown in FIGS. 1 and 2, the film drive down assembly 38 may include a drive down roller 40, a support 42, an actuation mechanism 46, a roping apparatus 48, and a latching assembly 50. The support 42 may include a shaft 52, a leg 54 extending substantially alongside the shaft 52, and a lever 56. The lever 56 may extend at an angle from a bottom end of the leg 54. The shaft 52 may rotatably support the drive down roller 40. The support 42 may be rotatably mounted by a pivot connection 58 on its bottom end either directly or indirectly to the packaging material dispenser 10. The top end of the support 42 may move freely, and thus, the entire support 42 may rotate about an axis extending through the pivot connection 58, allowing the support 42 to move between a relatively vertical position and a tilted film drive down position, shown in FIGS. 1 and 2, respectively. When the drive down roller 40 is in the tilted film drive down position, the film web 12 will enter onto the surface of the drive down roller 40 at a first height. Due to the tilted position of the drive down roller 40, the film web 12 will be forced downward as it travels around the drive down roller 40, exiting the drive down roller 40 at a height lower than which it first engaged the drive down roller 40. The tilted position of the drive down roller 40 may be oriented such that portions of the film web 12 engaging the drive down roller 40 in the tilted drive down position be driven off the bottom of the drive down roller 40. Thus, selecting a desired drive down orientation of the roller is important.

Rotation of the support 42 about the pivot connection 58 may be achieved using the actuation mechanism 46 shown in FIG. 2. The actuation mechanism 46 may selectively engage the lever 56 during certain times in a wrap cycle. The actuation mechanism 46 may include, for example, an air cylinder activated pad, and/or any other suitable mechanical, electrical, or hydraulically powered device configured to project outwardly to abut and drive the lever 56 upwardly, thus causing clockwise rotation of the support 42 and the drive down roller 40 from the relatively vertical position of FIG. 1 to the tilted film drive down position of FIG. 2. The drive down roller 40 may remain in contact with the film web 12 throughout the wrap cycle, whether the drive down roller 40 is in the relatively vertical position or in the tilted film drive down position.

In one embodiment, the actuation mechanism 46 may cause the drive down roller 40 to move to its tilted film drive down position at the start of the wrap cycle, when the packaging material dispenser 10 is in an initial position. For example, as shown in FIG. 2, the actuation mechanism 46 may abut the lever 56. After, the air cylinder activated pad may retract inwardly out of the path of travel of the packaging material dispenser 10 as relative rotation is provided between the packaging material dispenser 10 and the load. Additionally or alternatively, the actuation mechanism 46 may include an abutment (not shown), wherein the packaging material dispenser 10 may be lowered while not rotating to bring the abutment into contact with the lever 56 and cause rotation of the support 42. Prior to providing relative rotation between the packaging material dispenser 10 and the load, the packaging material dispenser 10 may be moved so as not to be obstructed by the abutment.

The roping apparatus 48 may be configured to engage a least a portion of a bottom edge of the film web 12. The roping apparatus 48 may include, for example, a roping mechanism 60, a pulley 62, and a linking rolled cable 64. The roping mechanism 60 may be slidably or otherwise moveably mounted either directly or indirectly to the packaging material dispenser 10, such that the roping mechanism 60 may move upward and downward relative to the packaging material dispenser 10. In FIGS. 1 and 2, the roping mechanism 60 is shown in lowered and raised positions, respectively. The roping mechanism 60 may move in between the lowered and raised positions due to movement of the support 42, which may be operatively connected to the roping mechanism 60 by the linking rolled cable 64. In one embodiment, the linking rolled cable 64 may include a first end looped or otherwise attached to the roping mechanism 60, and a second end looped or otherwise attached to an upper portion of the support 42. When the support 42 is in the relatively vertical position of FIG. 1, the roping mechanism 60 may be in the lowered position. When the support 42 rotates towards the tilted film drive down configuration, it may pull on the linking rolled cable 64. The pulling force may be translated by the pulley 62 into an upward movement of the first end of the linking rolled cable 64, causing the roping mechanism 60 to move towards the raised position. As long as support 42 and drive down roller 40 remains in the tilted film drive down configuration, the roping mechanism 60 may remain in the raised position. When the support 42 is released, and moves back to its relatively vertical position, the roping mechanism 60 may move back to the lowered position.

Preferably, the roping mechanism 60 may include low friction materials, for example unpainted steel bars or elements coated with zinc chromate. In one embodiment, the roping mechanism 60 may include a conventional roping element, configured to push the base or bottom portion of the film web 12 upward into itself, gathering the base or bottom portion of the film web 12 into a conventional rope. In an alternative embodiment, the roping mechanism 60 may include a cable rolling element having a v-shaped circumferential groove for engaging an edge of the film web 12. The cable rolling element is placed immediately downstream of a coated idle roller, such as, for example, the downstream pre-stretch idle roller 34 shown in FIGS. 1 and 2. This positioning of the cable rolling element creates a rolled cable of film that is capable of maintaining its structural integrity as a rope structure during and after wrapping of a load. The cable rolling element and downstream pre-stretch idle roller 34 may form a "rolled cable rolling means" for rolling a portion of the film web into a rolled cable of film. The rolled cable rolling means rolls an outer edge of the film web inward upon itself and toward the center of the film web. The film is rolled upon itself to form a tightly rolled cable of film, or a high tensile rolled cable of film along an edge of the film web 12. As used herein, a "rolled cable of film" or a "rolled cable" or a "rolled rope" are intended to denote a specific type of "roped" packaging material, where the film web has been rolled upon itself to create the rolled cable structure. An example is shown, in cross section in FIG. 11.

Once the support 42 rotates into the position shown in FIG. 2, it may engage the latching mechanism 50. The latching mechanism 50 may include a catch, configured to receive and hold a bolt member 66 mounted to the top end of the support 42. As long as the bolt member 66 is held in the catch, the support 42 and the drive down roller 40 may be locked in the tilted film drive down position, and thus, the roping mechanism 60 may be held in the raised position. In order to release the bolt member 66, the latching mechanism 50 may include a release device 68. Actuation of the release device 68 may serve to unlock (release) the catch to allow the bolt member 66 to escape, thus allowing the support 42 and drive down roller 40 to return to the relatively vertical position of FIG. 1. The release device 68 may include, for example, a spring steel release pad. The spring steel release pad 68 may be configured to engage an abutment 69 mounted on a non-rotating frame 71, such as, for example, a wheel abutment. At a pre-determined point in the wrap cycle, the spring steel release pad 68, may be brought into contact with the abutment 69, causing the spring steel release pad 68 to bend inwardly in the direction of the load. That inward movement of the spring steel release pad 68 may unlock the catch, allowing the bolt member 66 to escape. Continued movement of the packaging material dispenser 10 may disengage the abutment 69 from the spring steel release pad 68, which may flex back outwardly due to its inherent resiliency. The catch may be returned to the locking position by the outward movement of the spring steel release pad 68 and/or by the force generated by a return spring or other suitable biasing device. The next time in the wrap cycle that the support 42 moves to the tilted film drive down position, the bolt member 66 may once again be received and held by the catch.

According to another aspect of the invention, a method of using the packaging material dispenser 10 will now be described. In the beginning of the wrap cycle, the packaging material dispenser 10 may be located in an initial position. The initial position may be at or near the top of a load, wherein the packaging material dispenser 10 will move downward relative to the load during the wrap cycle. However, it is also contemplated that the initial position may be at the bottom of the load, wherein the packaging material dispenser 10 will move upward relative to the load during the wrap cycle. In this initial position, the actuation mechanism 46 may abut the lever 56 to move the drive down roller 40 into the tilted film drive down position of FIG. 2. The drive down roller 40 may be held in this position due to engagement of the bolt member 66 in the catch, even when the actuation mechanism 46 moves out of abutting contact with the lever 56. As described above, when the drive down roller 40 is moved into the tilted film drive down position, the roping mechanism 60 is lifted into the raised position by the linking rolled cable 64. As the roping mechanism 60 moves into the raised position, it may engage a bottom edge portion of the film web 12 to form the rope 49. In an embodiment where the roping mechanism 60 is a conventional roping element, a rope 49 formed may be a conventional gathered or bunched rope of film. In an alternative embodiment, where the roping mechanism 60 is a cable rolling element having a v-shaped circumferential groove for engaging the film web 12, and if the cable rolling element is positioned in close juxtaposition to the downstream side of a coated idle roller, such as, for example, downstream pre-stretch idle roller 34, the resultant rope 49 may be a tightly rolled cable of film that is better capable of maintaining its structural integrity as a rope structure during and after wrapping of a load.

The packaging material dispenser 10 may begin to dispense the film web 12. The pre-stretch assembly 22 may stretch the film web 12, which may travel downstream from the pre-stretch assembly 22, engage the raised roping mechanism 60, and flow towards the drive down roller 40. As the film web 12 passes over the roping mechanism 60, the bottom of the film web 12 may form the rope 49, shown in FIGS. 2 and 14. Additionally, the roping mechanism 60 raises the bottom edge of the film web 12 before it enters onto the drive down roller 40. As the film web 12 moves over the drive down roller 40, in the tilted drive down position, the angle of the drive down roller 40 may drive the film web 12 downward, such that the film web 12 may leave the drive down roller 40 at a lower elevation than when it first engaged the drive down roller 40 (shown in FIGS. 9 and 10). Due to the drive down roller 40 driving down the film web 12, the lower portion of the film web 12, including the rope 49, may be at an elevation lower than the bottom of a load and the top of a pallet, thus helping to secure the load to the pallet, as previously described.

As the film web 12 is dispensed from the packaging material dispenser 10, relative rotation may be provided between the packaging material dispenser 10 and a load 184 (shown in FIG. 12) to be wrapped. The packaging material dispenser 10 may also travel substantially vertically relative to the load 184. The movement of the packaging material dispenser 10 may lift or otherwise move the lever 56 out of abutment with the actuation mechanism 46. Additionally or alternatively, the actuation mechanism 46 may retract. However, as described above, the drive down roller 40 may remain in the tilted film drive down position due to the bolt member 66 being held within the catch. At some point during the wrapping cycle, the spring steel release pad 68 may approach the location at which an abutment 69 is mounted. At that height, the movement of the packaging material dispenser 10 may bring the spring steel release pad 68 into contact with that abutment 69, thus triggering the release of the catch to free the bolt member 66. Upon release of the bolt member 66, the support 42 may rotate towards the relatively vertical position, thus allowing the roping mechanism 60 to return to the lowered position. Accordingly, the bottom edge portion of the film web 12 may no longer form the rope 49 as the film web 12 is supplied to the load.

Vertical movement of the packaging material dispenser 10 away from the initial position, combined with relative rotation between the packaging material dispenser 10 and the load, may serve to spirally wrap the film web 12 about the load. Nearing the end of the wrap cycle, the film web 12 may be cut and secured onto the load. When the packaging material dispenser 10 returns to the initial position, the method may repeat as the actuation mechanism 46 may once again abut the lever 56 to move the drive down roller 40 into the tilted film drive down position of FIG. 2.

Additionally or alternatively, the roping mechanism 60 may be configured to always be at least partially engaged with a portion of the film web 12 to form the bottom portion of the film web 12 into a rolled cable of film 49. The partially engaged position of the roping mechanism 60 may include any position between the positions shown in FIGS. 1 and 2. Such a position is desirable for creating a rolled cable of film to be carried throughout the wrap process. By leaving the roping mechanism 60 at least partially engaged during the entire wrap cycle, the rolled cable of film forms a "rip stop" using the bottom portion of the film web 12 that may carry a partially ruptured film web until it re-engages the rest of web. This reduces film breaks during the wrap cycle and/or permits a higher wrapping force without film breaks. Testing has shown that using a two to three inch rolled cable throughout the wrap cycle may produce such benefits (as opposed to a 5 inch or greater rope used to secure the load to the pallet). At times in the wrap cycle where the roping mechanism 60 fully engages the film web 12, a thicker rope incorporating a larger portion of the film web 12 may be produced. The "rip stop" is preferably a rolled cable of film and thus this embodiment may be used exclusively with a roping mechanism 60 in the form of a cable rolling element positioned immediately downstream from a coated idle roller 34 to roll the bottom portion of the film web 12 into a rolled cable of film.

Figure 3:
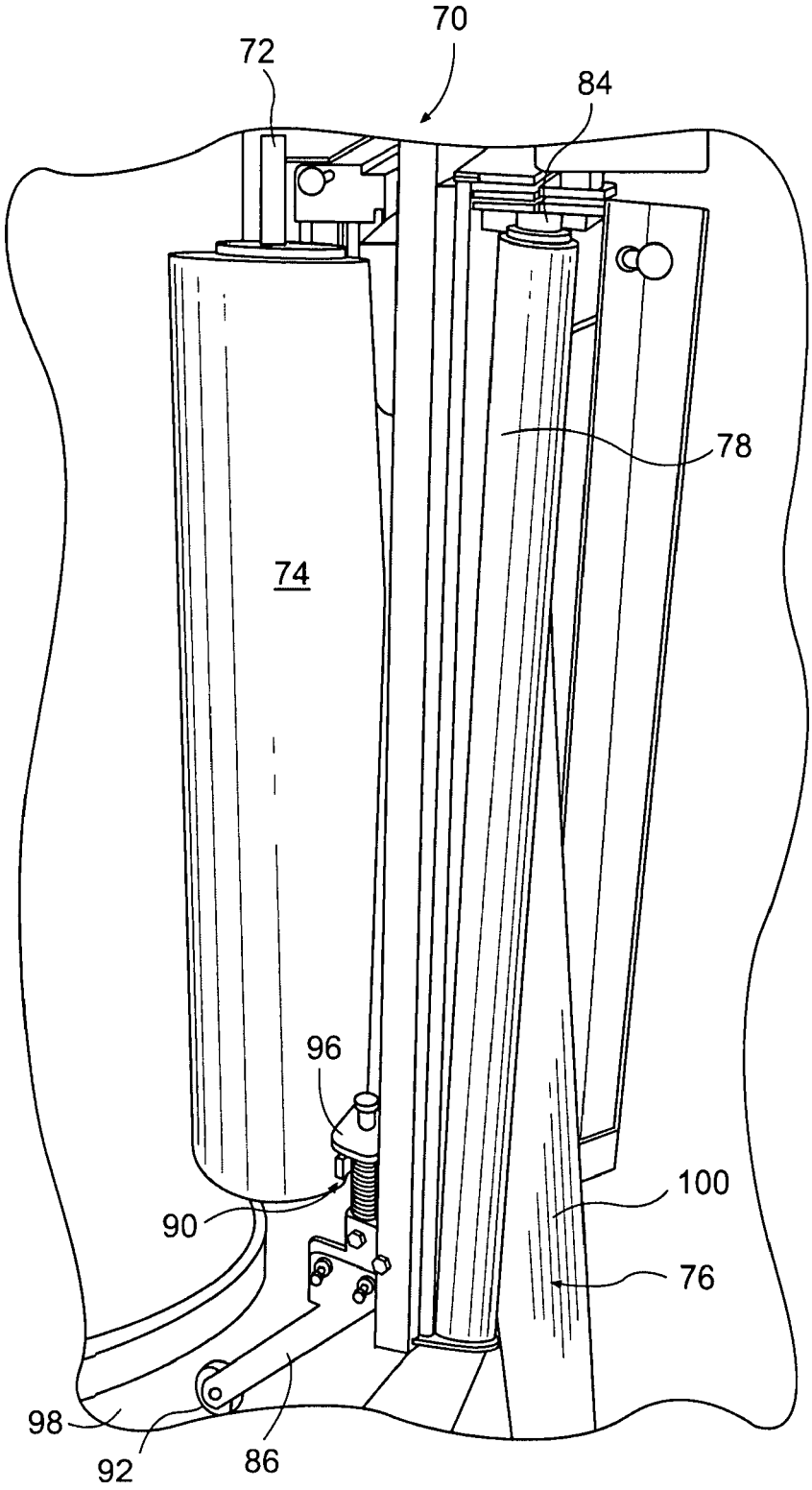
FIG. 3 is an isometric view of an alternative embodiment of a film dispenser, with a drive down roller in a first substantially vertical position, according to an aspect of the invention.

As embodied herein and as shown in FIG. 3, an alternative embodiment of a packaging material dispenser 70 may also include a roll carriage 72 in which a roll of film 74 is mounted, a pre-stretch assembly (not shown), and a film drive down assembly 76. The roll carriage 72 and pre-stretch assembly may resemble the roll carriage 14 and pre-stretch assembly 22 of the packaging material dispenser 10 described with respect to FIGS. 1 and 2, and may operate in a similar fashion.

The film drive down assembly 76 may include a drive down roller 78, a support 80, and a roping mechanism 82. The support 80 may include a shaft 84, a leg 86 extending substantially alongside the shaft 84, a lever 88, and a biasing mechanism 90. The lever 88 may extend at an angle from a bottom end of the leg 86. The free end of the lever 88 may include a rotatable wheel 92 mounted thereon. The shaft 84 may rotatably support the drive down roller 78. The support 80 may be rotatably mounted by a pivot connection 94 on its bottom end either directly or indirectly to the packaging material dispenser 70. The top end of the support 80 may move freely, and thus, the support 80 and drive down roller 78 may rotate about an axis extending through the pivot connection 94 between a relatively vertical position and a tilted film drive down position, shown in FIGS. 3 and 4, respectively. At least drive down roller 78 may always engage at least a portion of the film web 100 during the entire wrap cycle.

Thus, the drive down roller 78 engages the film web 100 in both the relatively vertical position and the tilted film drive down position.

The biasing mechanism 90 may include, for example, a coil spring, having a first end abutting the lever 88, and a second end abutting a fixed plate 96 mounted on the packaging material dispenser 70. The biasing mechanism 90 creates a force on lever 88 and the fixed plate 96 that biases the support 80 into the substantially vertical position.

Rotation of the support 80 against the force of the biasing mechanism 90 may occur when the wheel 92 engages a fixed surface 98, such as, for example, a plate or the floor. When the packaging material dispenser 70 is lowered substantially vertically toward the fixed surface 98, the wheel 92 will engage the fixed surface 98, causing the support 80 to begin to pivot toward the tilted film drive down position. Continued downward movement of the packaging material dispenser 70 causes the wheel 92 to roll along the fixed surface 98, decreasing the angle between the lever 88 and the fixed surface 98, while increasing the tilt angle of the support 80. As long as the wheel 92 remains in contact with the fixed surface 98, the support 80 will remain in the tilted film drive down position. It is contemplated that the wheel 92 and the fixed surface 98 may come into contact at the start of the wrap cycle, when the packaging material dispenser 70 is in a lowered position. It is also contemplated that the wheel 92 and the fixed surface 98 may engage at the end of the wrap cycle, when the packaging material dispenser 70 returns to the lowered position.

As the packaging material dispenser 70 moves away from the fixed surface 98, the wheel 92 may roll along the fixed surface 98 as the biasing mechanism 90 forces the wheel 92 against the fixed surface 98, bringing the support 80 and drive down roller 78 towards the substantially vertical position. As the wheel 92 rolls, the angle between the lever 88 and the fixed surface 98 increases, and the tilt angle of the support 80 progressively decreases. When movement of the packaging material dispenser 70 brings the wheel 92 out of contact with the fixed surface 98, there will no longer be a force counteracting the force generated by the biasing mechanism 90, and the support 80 will return and remain in the substantially vertical position.

Figure 4:
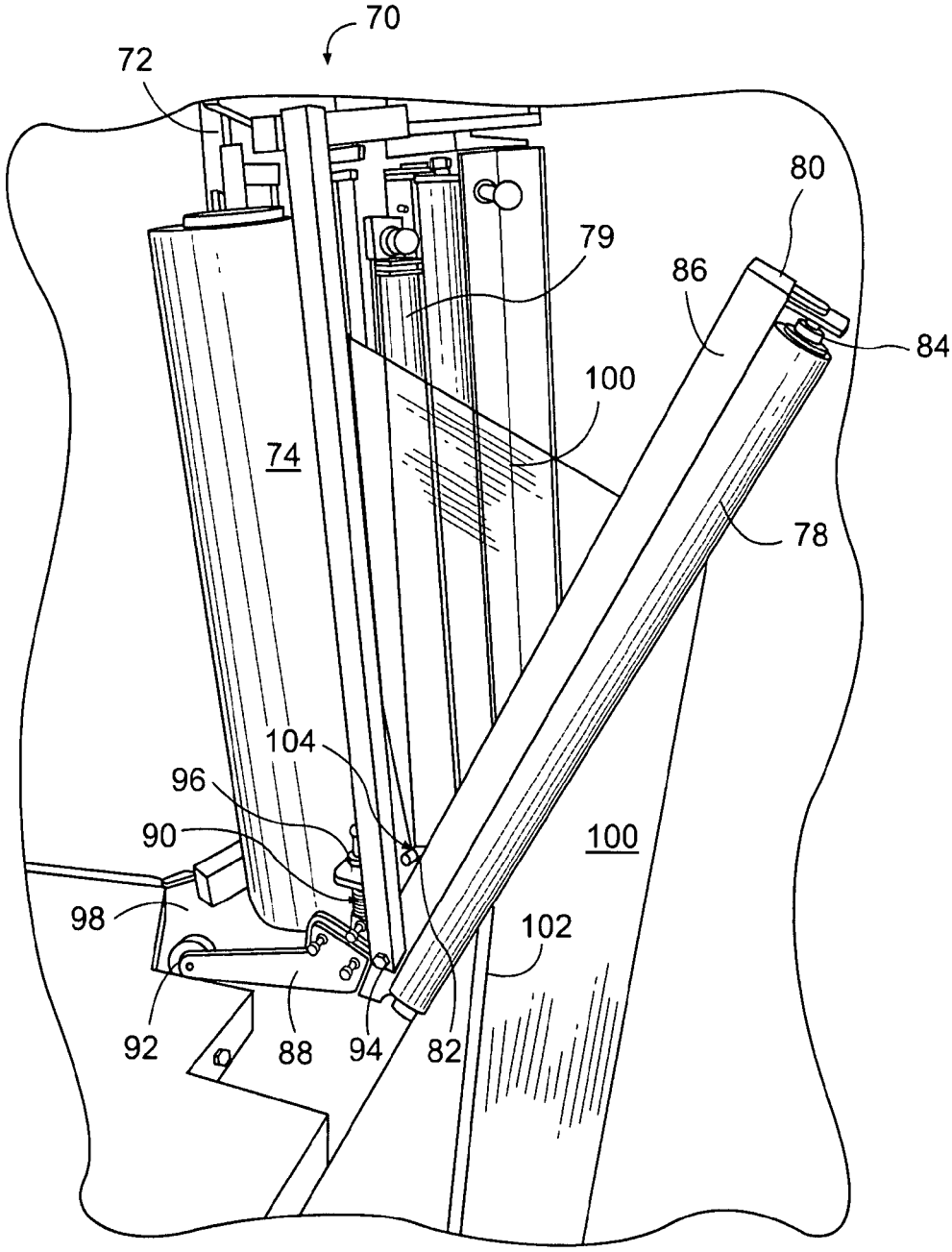
FIG. 4 is an isometric view of the film dispenser of FIG. 3, with the drive down roller in a second tilted position, according to one aspect of the invention.

The roping mechanism 82 may be configured to engage a least a portion of a bottom edge of the film web 100 to form a rope 102, as shown in FIG. 4. As previously mentioned, a rope may broadly encompass conventional ropes as well as rolled cables of film. The roping mechanism 82 may include a conventional roping element, wherein engagement between the bottom edge portion of the film web 100 and the conventional roping element will push the base or bottom portion of the film web 100 upward into itself, gathering the base or bottom portion of the film web 100 into a conventional rope. In an alternative embodiment, where the roping mechanism 82 is a cable rolling element having a v-shaped circumferential groove 104 for engaging the film web 100, placed in close juxtaposition to the downstream side of a coated idle roller, such as, for example, the idle roller 79, the roping mechanism 82 will create a rolled cable of film that is capable of maintaining its structural integrity as a rope structure during and after wrapping of a load.

If the roping mechanism 82 includes a conventional roping element, then the roping mechanism 82 may be positioned at any suitable location upstream from the drive down roller 78. If, on the other hand, the roping mechanism 82 includes a cable rolling element, then the roping element should be positioned immediately next to the downstream side of the coated idle roller 79 to produce the rolled cable of film. The cable rolling element and the coated idle roller 79 may form a "rolled cable rolling means" for rolling a portion of the film web 100 into a rolled cable of film. The rolled cable rolling means rolls an outer edge of the film web 100 inward upon itself and toward the center of the film web 100. The film is rolled upon itself to form a tightly rolled cable of film, or a high tensile rolled cable of film along an edge of the film web 100. An example is shown in FIG. 11.

As embodied herein and shown in FIG. 4, neither the drive down roller 78 nor the roping mechanism 82 is connected to a power source. The roping mechanism 82 preferably does not include a coating. A preferred material from which the roping mechanism 82 may be made is nylon. Other suitable materials may be used.

The roping mechanism 82 may be preferably positioned upstream from the drive down roller 78 if the roping mechanism 82 is a conventional roping element. The roping mechanism 82 may be preferably positioned immediately adjacent to a downstream side of the coated idle roller 79 if the roping element is a cable rolling element. In either case, the roping mechanism 82 is configured to receive a bottom edge of the film web 100 in order to form the bottom portion of the film web 100 into a rope 102. This positioning is preferred such that, in use, the film web 100 is pulled off the roll 74, passes through the pre-stretch assembly (not shown), over the coated idle roller 79 and the roping mechanism 82, around the drive down roller 78, and to the load. Apart from forming the film web 100 into the rope 102, the roping mechanism 82 may also elevate the bottom edge of the film web 100 onto the drive down roller 78 to help keep the film web 100 from slipping beneath the bottom of the drive down roller 78.

According to another aspect of the invention, the roping mechanism 82 may be positioned at a base above which the packaging material dispenser 70 moves substantially vertically. When the packaging material dispenser 70 is at the base, the roping mechanism 82 engages an edge of the film web 100 as it moves toward the load. Means may be employed to provide relative rotation between the load and the packaging material dispenser 70 to wrap the film web 100 around the load, such as, for example, a rotatable arm, a rotatable ring, or a turntable. As the packaging material dispenser 70 moves upward, the edge of the film web 100 disengages from the roping mechanism 82. When the packaging material dispenser 70 returns to the base as the end of the wrap cycle approaches, the edge of the film web 100 re-engages the roping mechanism 82 and is formed into the rope 102, which is wrapped around the base of the load and top of the pallet supporting the load. Additionally or alternatively, the driving down of the film web 100 by the drive down roller 78 may assist in bringing the film web 100 into engagement with the roping mechanism 82.

According to another aspect of the invention, a method of using the packaging material dispenser 70 will now be described. In the beginning of the wrap cycle, the packaging material dispenser 70 may be located in an initial position, with the wheel 92 engaging the fixed surface 98. As such, the drive down roller 78 may be held in the tilted film drive down position of FIG. 4, and at least a portion of the film web 100 may engage the roping mechanism 82.

The packaging material dispenser 70 may begin to dispense the film web 100. The pre-stretch assembly (not shown) may stretch the film web 100, which may travel downstream, pass over the roping mechanism 82, and flow towards the drive down roller 78. As the film web 100 passes over the roping mechanism 82, the rope 102 may be formed along the bottom edge portion of the film web 100. As the film web 100 moves around the drive down roller 78, the angle of the drive down roller 78 may drive the film web 100 downward, such that the film web 100 may leave the drive down roller 78 at a lower elevation than when it entered onto the drive down roller 78. Due to the drive down roller 78 driving down the film web 100, the lower portion of the film web 100 may be at an elevation lower than the bottom of a load and the top of a pallet, thus helping to secure the load to the pallet, as previously described, and also shown in FIGS. 9 and 10.

As the film web 100 continues to be dispensed from the packaging material dispenser 70, relative rotation may be provided between the packaging material dispenser 70 and the load. Also, the packaging material dispenser 70 may travel substantially vertically relative to the load. The movement of the packaging material dispenser 70 may lift the wheel 92 out of contact with the fixed surface 98, while bringing the film web 100 out of contact with the roping mechanism 82. Accordingly, the bottom edge portion of the film web 100 may no longer be formed into the rope 102 as the film web 100 is supplied to the load. When the wheel 92 is completely out of contact with the fixed surface 98, the support 80 may be biased towards and held in the relatively vertical position by the biasing mechanism 90.

Vertical movement of the packaging material dispenser 70 away from the initial position, combined with relative rotation between the packaging material dispenser 70 and the load, may serve to spirally wrap the film web 100 about the load. Nearing the end of the wrap cycle, the packaging material dispenser 70 may return to its initial position, bringing the wheel 92 into engagement with the fixed surface 98 to cause the support 80 to move into the tilted position, while also bringing the film web 100 into engagement with the roping mechanism 82 to form the bottom edge of the film web 100 into the rope 102. Once the film web 100 is cut and sealed to the load, the process may repeat itself for a subsequent wrap cycle with a new load.

Additionally or alternatively, the roping mechanism 82 may be configured to always be at least partially engaged with the film web 100 to form the bottom portion of the film web 100 into the "rip stop" described in a previous embodiment. The partially engaged position of the roping mechanism 82 may include any position between the positions shown in FIGS. 3 and 4. The "rip stop" may carry a partially ruptured film web until it re-engages the rest of web. This reduces film breaks and/or permits a higher wrapping force without film breaks. Testing has shown that using a two to three inch rope throughout the wrap cycle may produce such benefits. At times in the wrap cycle where the roping mechanism 82 fully engages the film web 100, a thicker rope structure may be produced.

As embodied herein and as shown in FIGS. 5-8, another alternative embodiment of a packaging material dispenser 106 may also include a roll carriage 108 in which a roll of film 110 is mounted, a pre-stretch assembly 112, and a film drive down assembly 114. The roll carriage 108 and pre-stretch assembly 112 may resemble the roll carriages 14 and 72, and pre-stretch assembly 22, of the packaging material dispensers 10 and 70 of FIGS. 1-4, and may operate in a similar fashion.

The film drive down assembly 114 may include a first drive down roller 116, a second drive down roller 118, a fixed frame assembly 120, an articulating frame assembly 122, and a drive down assembly 124. The fixed frame assembly 120 may include a vertical support 126 fixedly coupled to the packaging material dispenser 106. The fixed frame assembly 120 may also include a support bracket 128 may extend at an angle from a surface of the vertical support 126.

The articulating frame assembly 122 may include a horizontal support element 130 coupled to the packaging material dispenser 106. A first link 132 may be rotatably coupled to the horizontal support element 130 via a pivot connection 134. The second drive down roller 118 may be rotatably mounted on the first link 132. A second link 136 may be rotatably coupled to the horizontal support element 130 via a pivot connection 138. The first drive down roller 116 may be rotatably mounted on the second link 136. The first and second drive down rollers 116 and 118 may engage at least a portion of the width of the film web 172 during the entire wrap cycle.

The first and second links 132 and 136 may be coupled at or near their midsections by a third link 140. The third link 140 may be rotatably coupled to the first link 132 by a pivot connection 142. The third link 140 may include a bracket 144. A biasing mechanism 146, such as, for example, a spring, may have a first end fixedly coupled to the bracket 144, and a second end coupled to a mounting element 148 fixed to the second link 136. The first and second links 132 and 136 may move as a unit due to their respective connections to the third link 140, and thus, the first and second drive down rollers 116 and 118 may tilt together. First and second wheels 150 and 152 may be rotatably mounted on the bracket 144. The first and second wheels 150 and 152 may be arranged to contact opposing sides of a wall of the support bracket 128 of the fixed frame assembly 120, thus providing the articulating frame assembly 122 with lateral stability. A ramp assembly 154 may be coupled to a bottom side of the third link 140. The ramp assembly 154 may include a sloped surface 156, and first and second legs 158 and 160 attaching the ends of the sloped surface 156 to the third link.

Figure 6:
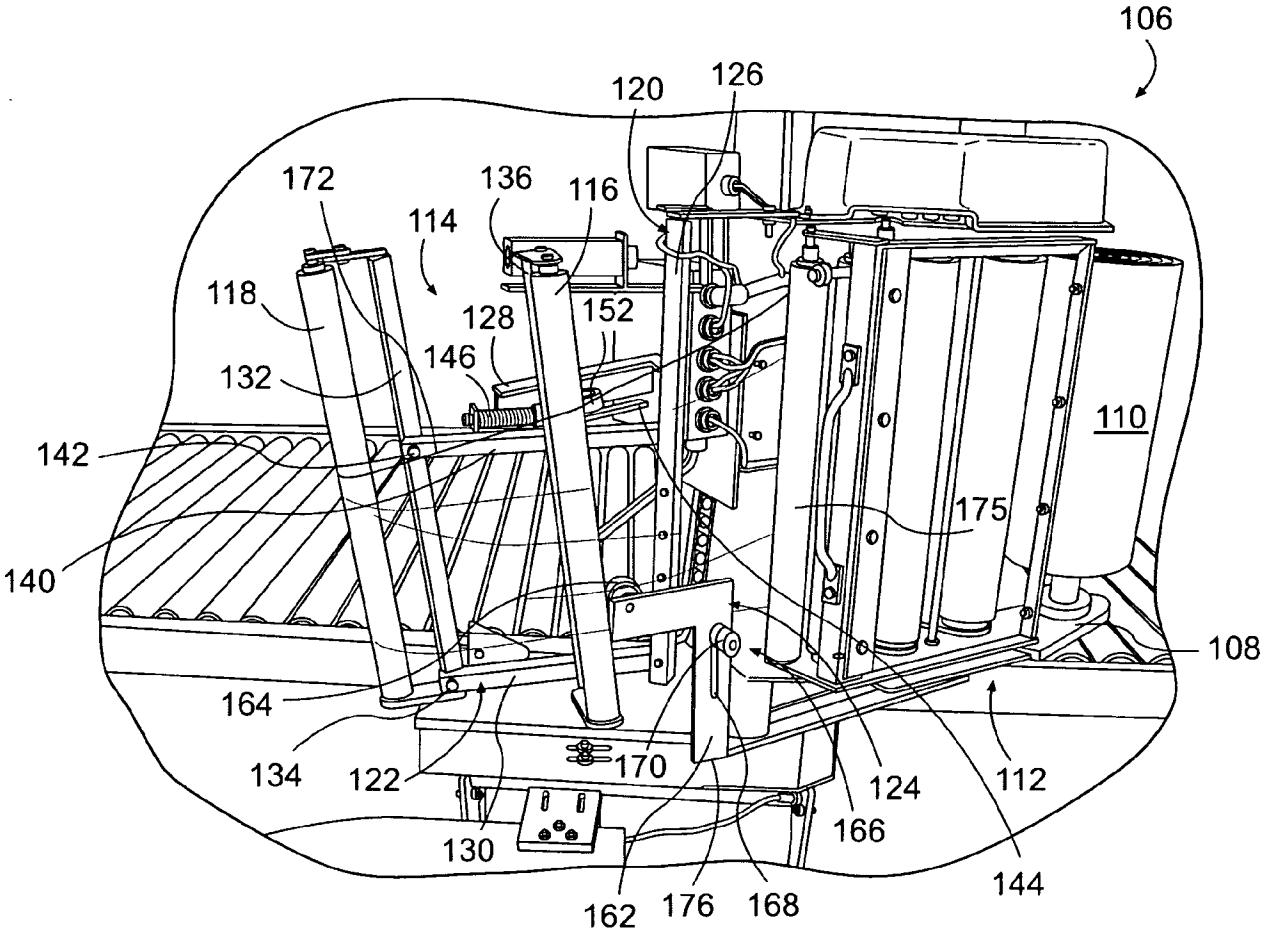
FIG. 6 is an isometric rear view of the film dispenser of FIG. 5, with the first drive down and second drive down rollers in the first substantially vertical position, according to one aspect of the invention.
Figure 8:
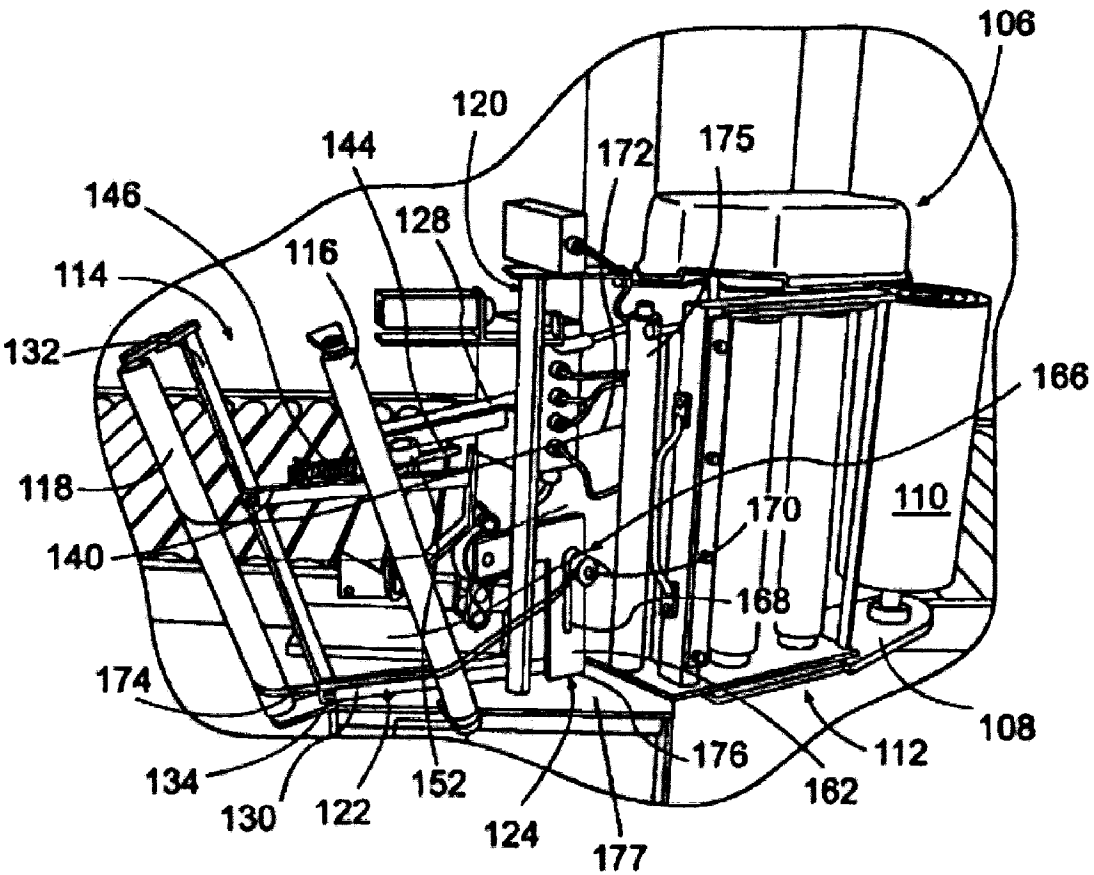
FIG. 8 is an isometric rear view of the film dispenser of FIGS. 5-7, with the first and second drive down rollers in the second tilted position, according to one aspect of the invention.

The drive down assembly 124 may include a drive down carriage 162 either directly or indirectly movably coupled to the packaging material dispenser 106. The drive down carriage 162 may include a first body portion on which a wheel 164 may be rotatably mounted. The drive down carriage 162 may also include a second body portion on which a roping apparatus 166 may be mounted. The second body portion may include a slot 168, and it is contemplated that the roping apparatus 166 may be fixed at any point along the slot 168, allowing for adjustment of the height at which a roping mechanism 170 of the roping apparatus 166 will be driven up into the film web 172 to form the lower portion of the film web 172 into the rope 174. The slot 168 may also be used to set the roping mechanism 170 so that it may at least partially engage the film web 172 throughout the wrap cycle. As shown in FIGS. 6 and 8, the roping mechanism 170 may be a cable rolling element positioned immediately downstream of an idle roller 175, which is preferably coated, such that the cable rolling element and the idle roller 175 may work the film web 172 into a rolled cable. It is also contemplated that the roping mechanism 170 may be a conventional roping element that may be placed upstream from the first and second drive down rollers 116 and 118 to form the bottom portion of the film web 172 into a conventional rope.

Figure 7:
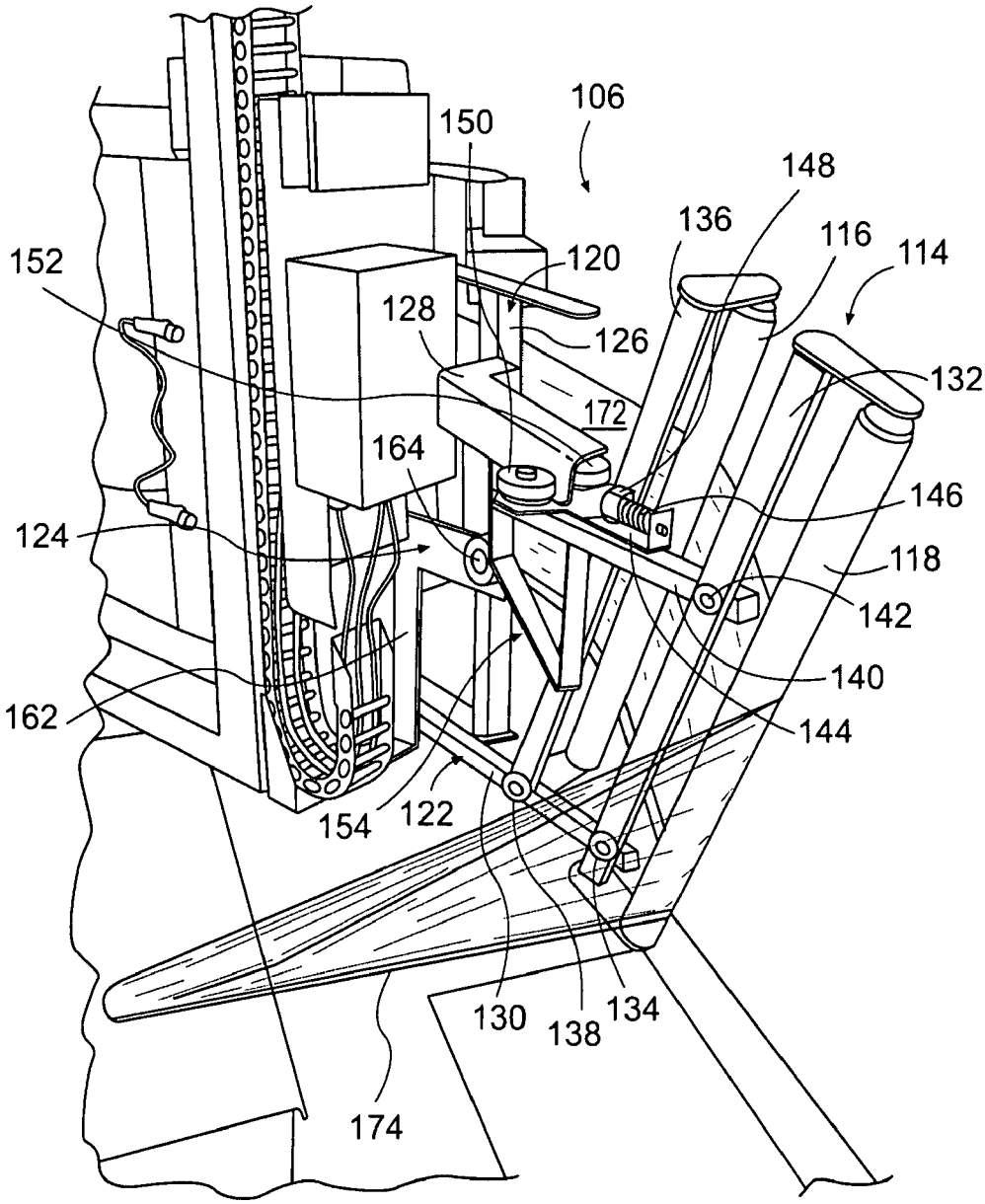
FIG. 7 is an isometric front view of the film dispenser of FIGS. 5 and 6, with the first and second drive down rollers in a second tilted position, according to an aspect of the invention.

The drive down carriage 162 may further include a surface engaging portion 176. When the packaging material dispenser 106 is lowered, the surface engaging portion 176 may be brought into contact with a surface 177. If the packaging material dispenser 106 continues to travel toward the surface 177 after the surface engaging portion 176 has engaged the surface 177, the drive down carriage 162 may be driven upwards relative to the packaging material dispenser 106 and the fixed and articulating frame assemblies 120 and 122. This relative movement may bring the wheel 164 into contact with the sloped surface 156 of the ramp assembly 154. The upward force of the wheel 164 against the sloped surface 156 may cause the third link 140 of the articulating frame assembly 122 to move away from the fixed frame assembly 120, as shown in FIGS. 7 and 8. During this movement, the third link 140 may move in linear path as the first and second wheels 150 and 152 roll against the wall. This movement of the third link 140 causes the first and second links 132 and 136 to pivot about pivot connections 134 and 138, respectively, driving the first and second drive down rollers 116 and 118 to the tilted film drive down position shown in FIGS. 7 and 8. When the first and second drive down rollers 116 and 118 are in the tilted film drive down position, they may drive the film web 172 down past the bottom of the load being wrapped so that the film web 172 secures the bottom of the load to the pallet on which the load rests. As shown, the second drive down roller 118 is tilted into alignment with the downward direction of the film web 172 established by the first drive down roller 116.

In addition to bringing the wheel 164 into engagement with the sloped surface 156, upward movement of the drive down carriage 162 relative to the packaging material dispenser 106 may also bring the roping mechanism 170 into engagement with the bottom portion of the film web 172, allowing the roping mechanism 170 to form the bottom portion of the film web 172 into the rope 174. As previously discussed, the rope 174 helps to secure the load to the pallet. Additionally, the roping mechanism 170 may elevate the bottom edge of the film web 172 before it enters onto the first and second drive down rollers 116 and 118, helping to prevent the film web 172 from sliding off the bottoms of the drive down rollers 116 and 118 and causing other malfunctions.

Preferably, the roping mechanism 170 may include low friction materials, for example unpainted steel bars or elements coated with zinc chromate. In one embodiment, the roping mechanism 170 may include a conventional roping element, configured to push the base or bottom portion of the film web 172 upward into itself, gathering the base or bottom portion of the film web 172 into a conventional rope. The conventional roping element may be positioned at any point upstream of the first and second drive down rollers 116 and 118. In an alternative embodiment, the roping mechanism 170 may include a cable rolling element having a v-shaped circumferential groove for engaging the film web 172. The cable rolling element may be placed immediately next to the downstream side of the idle roller 175, preferably coated, to create a rolled cable film that is capable of maintaining its structural integrity as a rope structure during and after wrapping of a load. The cable rolling element and the idle roller 175 may form a "rolled cable rolling means" for rolling a portion of the film web into a rolled cable of film. The rolled cable rolling means rolls an outer edge of the film web inward upon itself and toward the center of the film web. The film is rolled upon itself to form a tightly rolled cable of film, or a high tensile rolled cable of film along an edge of the film web 172. An example is shown in FIG. 11.

Figure 5:
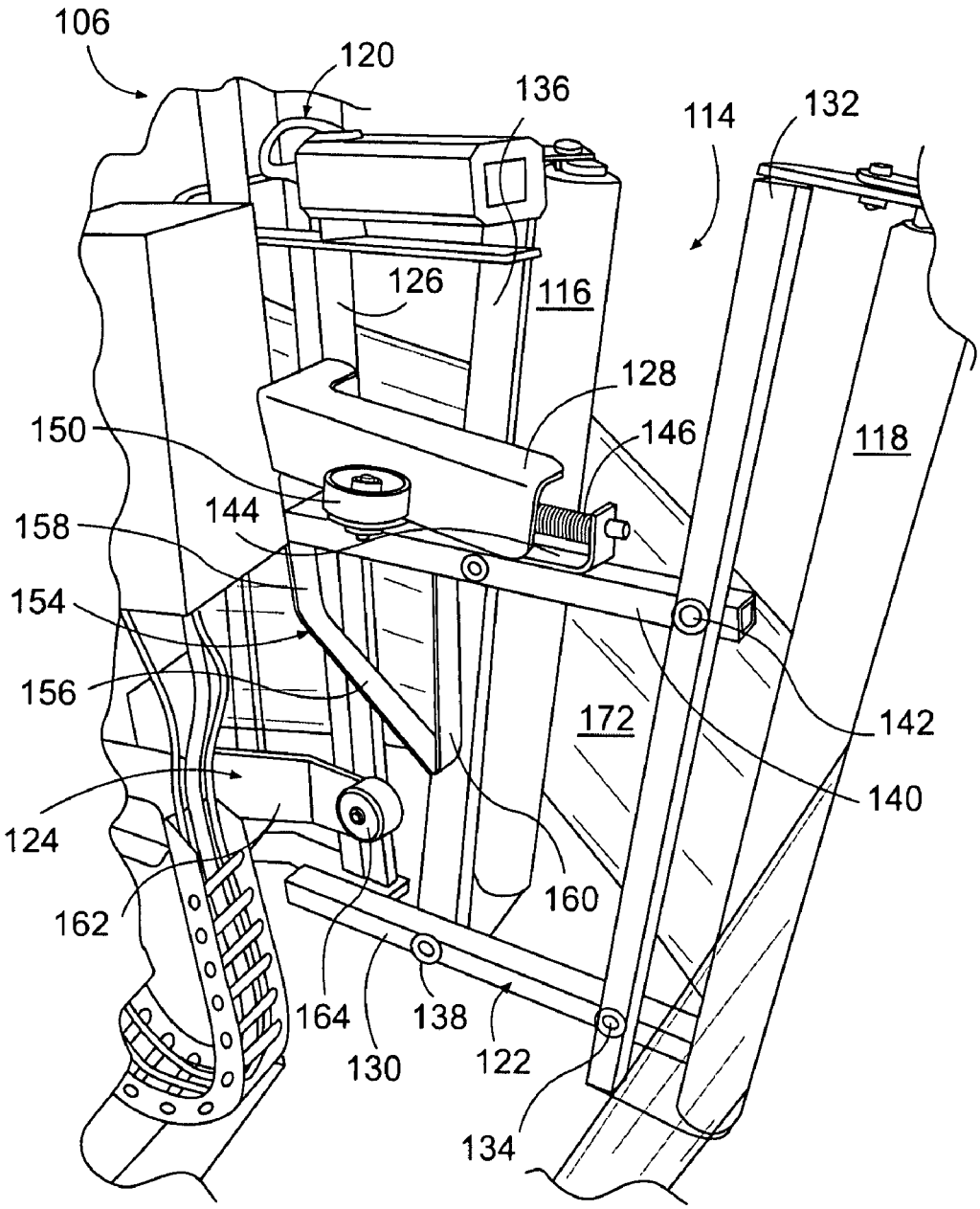
FIG. 5 is an isometric front view of another alternative embodiment of a film dispenser, with a first drive down roller and a second drive down roller in a first substantially vertical position, according to an aspect of the invention.

The biasing mechanism 146 between the mounting element 148 and the bracket 144 biases the second link 136 toward the non-tilted position of FIGS. 5 and 6. Due to its connection with the second link 136 via the third link 140, the first link 132 is also biased into the non-tilted position by the biasing mechanism 146. Movement of the second link 136 to the tilted film drive down position creates relative movement between the bracket 144 and the mounting element 148 on the second link 136. The relative movement counteracts the biasing force of the biasing mechanism 146, causing the biasing mechanism to stretch. As long as the wheel 164 holds the articulating frame assembly 122 in the tilted film drive down position, the biasing mechanism 146 cannot move the articulating frame assembly 122 back to the non-tilted position. However, if the drive down carriage 162 is brought out of contact with the surface 177, and the wheel 164 begins to move in a downward direction, the biasing mechanism 146 will contract, biasing the articulating frame assembly 122 and its components into the non-tilted position.

While the packaging material dispenser 106 is shown as having two tiltable drive down rollers 116 and 118, it is also contemplated that the first drive down roller 116 may be fixedly mounted to the packaging material dispenser 106 in a substantially vertical position. For example, the pivot connection 138 may be replaced by a fixed connection, and the second link 136 may be uncoupled from the third link 140. In such an embodiment, engagement between the wheel 164 and the sloped surface 156 of the ramp assembly 154 may only drive the first link 132 and the second drive down roller 118 into the tilted film drive down position. Also, the second end of the biasing mechanism 146 may be coupled to the fixed frame assembly 120 at, for example, the vertical portion 126.

It is also contemplated that the first drive down roller 116 may be removed. In such an embodiment, the roping mechanism 170, if it is a conventional roping element, may be positioned anywhere upstream of the second drive down roller 118 to form a conventional rope of film. Alternatively, if the roping mechanism 170 is a cable rolling element, then the roping mechanism 170 should be positioned immediately downstream from the coated idle roller 175 to provide for rolling of the film web 172 into a rolled cable of film.

According to another aspect of the invention, a method of using the packaging material dispenser 106 will now be described. In the beginning of the wrap cycle, the packaging material dispenser 106 may be located in an initial position, with the surface engaging portion 176 of the drive down carriage 162 engaging the surface 177. The engagement of the wheel 164 with the sloped surface 156 may cam the articulating frame assembly 122 to the tilted position. As such, the first and second drive down rollers 116 and 118 may be forced into the tilted film drive down position of FIGS. 7 and 8, and at least a portion of the film web 172 may engage the roping mechanism 170. The roping mechanism 170 will form the bottom portion of the film web 172 into the rope 174. If the roping mechanism 170 is a conventional roping element, the rope 174 will be a conventional rope. If, on the other hand, the roping mechanism 170 is a cable rolling element, the rope 174 will be a rolled cable of film.

The packaging material dispenser 106 may begin to dispense the film web 172. The pre-stretch assembly 112 may stretch the film web 172, which may travel downstream, pass over the roping mechanism 170, and flow towards the first and second drive down rollers 116 and 118. As the film web 172 passes over the roping mechanism 170, the rope 174 may be formed along the bottom edge portion of the film web 172. As the film web 172 moves around the first and second drive down rollers 116 and 118, the angles of the drive down rollers 116 and 118 may successively drive the film web 172 downward, such that the film web 172 may leave the second drive down roller 118 at a lower elevation than when it entered onto the first drive down roller 116. Due to the first and second drive down rollers 116 and 118 driving down the film web 172, a lower portion of the film web 172, including the rope 174, may be at an elevation lower than the bottom of a load and the top of a pallet, thus helping to secure the load to the pallet, as previously described.

As the film web 172 continues to be dispensed from the packaging material dispenser 106, the packaging material dispenser 106 may rotate relative to the load, while also traveling substantially vertically relative to the load. The movement of the packaging material dispenser 106 may lift or otherwise move the surface engaging portion 176 of the drive down carriage 162 out of contact with the surface 177, causing the drive down carriage 162 to move downward relative to the packaging material dispenser 106. Downward movement of the drive down carriage 162 relative to the packaging material dispenser 106 may bring the wheel 164 downward, allowing the ramp assembly 154 to move back to the position shown in FIGS. 5 and 6 due to the force provided by the biasing mechanism 146. When the wheel 164 is completely out of engagement with the sloped surface 156, the biasing mechanism 146 will bring and maintain the first and second drive down rollers 116 and 118 in the non-tilted position. Additionally, the lower portion of the film web 172 will be brought out of contact with the roping mechanism 170. Accordingly, the bottom edge portion of the film web 172 may no longer be formed into the rope 174 as the film web 172 is supplied to the load.

Vertical movement of the packaging material dispenser 106 away from the initial position, combined with relative rotation between the packaging material dispenser 106 and the load, may serve to spirally wrap the film web 172 about the load. Nearing the end of the wrap cycle, the packaging material dispenser 106 may return to the initial position, once again causing the drive down carriage 162 to engage the surface 177. This will in turn bring the wheel 164 into engagement with the sloped surface 156 to cause the articulated frame assembly 122 to move into the tilted film drive down position, while also bringing the roping mechanism 170 back up into engagement with the lower portion of the film web 172 to form the bottom portion of the film web 172 into the rope 174. Once the film web 172 is cut and sealed to the load being wrapped, the process may repeat itself for a subsequent wrap cycle with a new load.

As previously described, the packaging material dispenser 106 may utilize only a single tilting drive down roller, such as, for example, the second drive down roller 118. In such an embodiment, the method described above may apply, except that the second drive down roller 118 may move between tilted and non-tilted positions, while the first drive down roller 116 may be removed, or remain in a fixed position.

Additionally or alternatively, the roping mechanism 170 may be configured to always be at least partially engaged with the film web 172 to form the bottom portion of the film web 172. The partially engaged position of the roping mechanism 170 may include any position between the positions shown in FIGS. 6 and 8. By leaving the roping mechanism 170 at least partially engaged during the entire wrap cycle, it forms a "rip stop" that may carry a partially ruptured film web until it re-engages the rest of web. This reduces film breaks and/or permits a higher wrapping force without film breaks. Testing has shown that using a two to three inch rope throughout the wrap cycle may produce such benefits. At times in the wrap cycle where the roping mechanism 170 fully engages the film web 172, a thicker rope may be produced.

Figure 9:
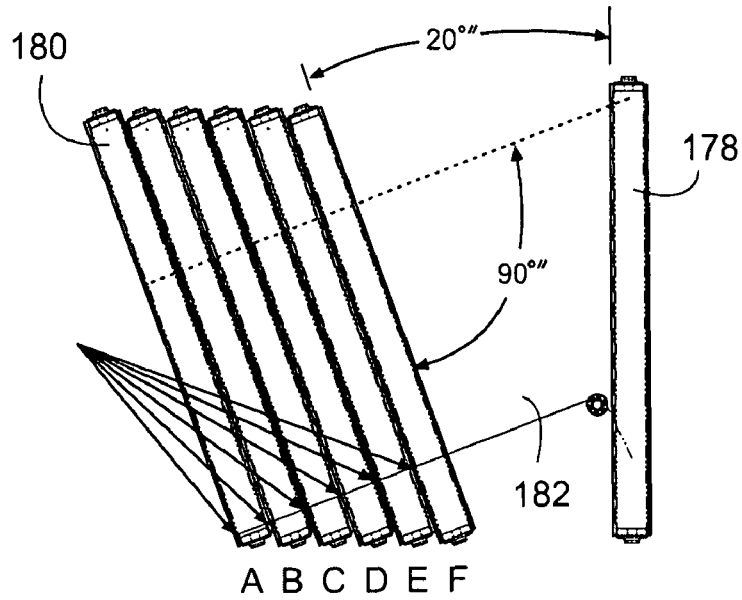
FIG. 9 is a diagram depicting alternative drive down roller arrangements for the film dispenser of FIGS. 5-8, and the film path for each of the alternative arrangements, according to an aspect of the invention.
Figure 10:
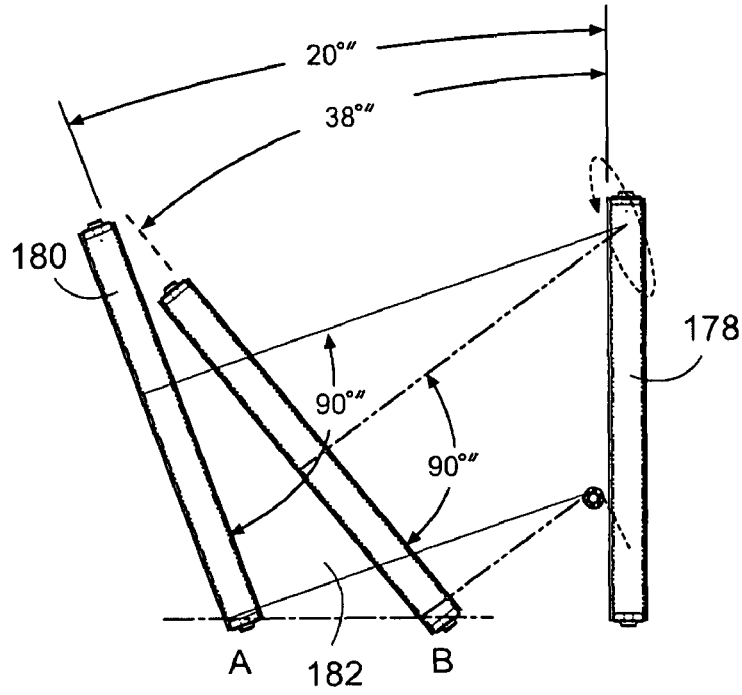
FIG. 10 is a diagram depicting two alternative drive down roller arrangements for the film dispenser of FIGS. 5-8, and also shows a film path for each of the alternatives, according to one aspect of the invention.

FIGS. 9 and 10 show a vertical drive down roller 178, and a tilted drive down roller 180. The vertical drive down roller 178 may include the idle rollers 34, 79, and/or 175, of FIGS. 1-8; while the tilted drive down roller 180 may include the drive down rollers 40, 78, and 118 of FIGS. 1-8. As shown in FIG. 9, the tilted drive down roller 180 may occupy positions A-F. The film web 182 will naturally seek a path perpendicular to the tilted drive down roller 180. As the tilted drive down roller 180 is moved closer to the vertical drive down roller 178 with its tilt angle remaining constant, the payoff point, or point where the film web 182 leaves the tilted drive down roller 180, moves up the tilted drive down roller 180. The lowest or most desirable payoff point can be found at position A, which is farthest from the vertical drive down roller 178. At each position B-F to the right, the payoff point moves higher.

In FIG. 10, the tilted drive down roller 180 is shown at two positions, A and B. At position A, the tilted drive down roller 180 has a tilt angle of 20° relative to the vertical drive down roller. At position B, the tilted drive down roller 180 has a tilt angle of 38°. Also, position A is farther away from the vertical drive down roller 178 than position B. Although the payoff point is the same for the tilted drive down roller 180 regardless of whether it occupies position A or position B, position A is preferable because the film angle of the film web 182 for position A (shown in solid line) is less severe than the film angle of the film web 182 for position B (shown in dotted line). The greater the film angle, the more likely a top edge of the film web 182 will roll down the vertical drive down roller 178, causing a rope when roping may not be desired.

Figure 12:
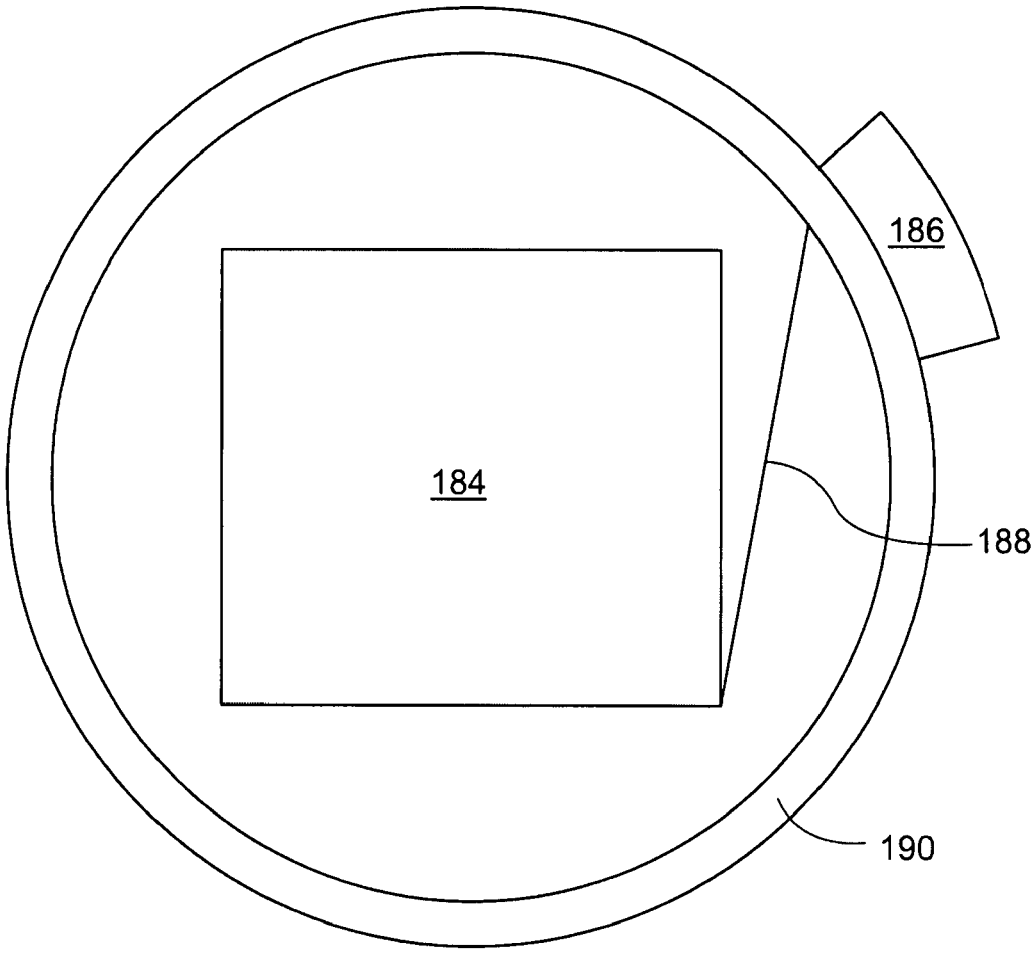
FIG. 12 is a top view of an embodiment of a rotatable ring wrapping apparatus according to one aspect of the invention.

FIG. 12 shows a top view of a load 184, a packaging material dispenser 186 for dispensing a film web 188, and a means for providing relative rotation between the packaging material dispenser 186 and the load 184. In this embodiment, the means for providing relative rotation includes a rotating ring 190. The rotating ring 190 may rotate and carry the packaging material dispenser 186 around the load, while also moving relative to the load 184 along the axis of rotation to spirally wrap the film web 188 around the load 184.

Figure 13:
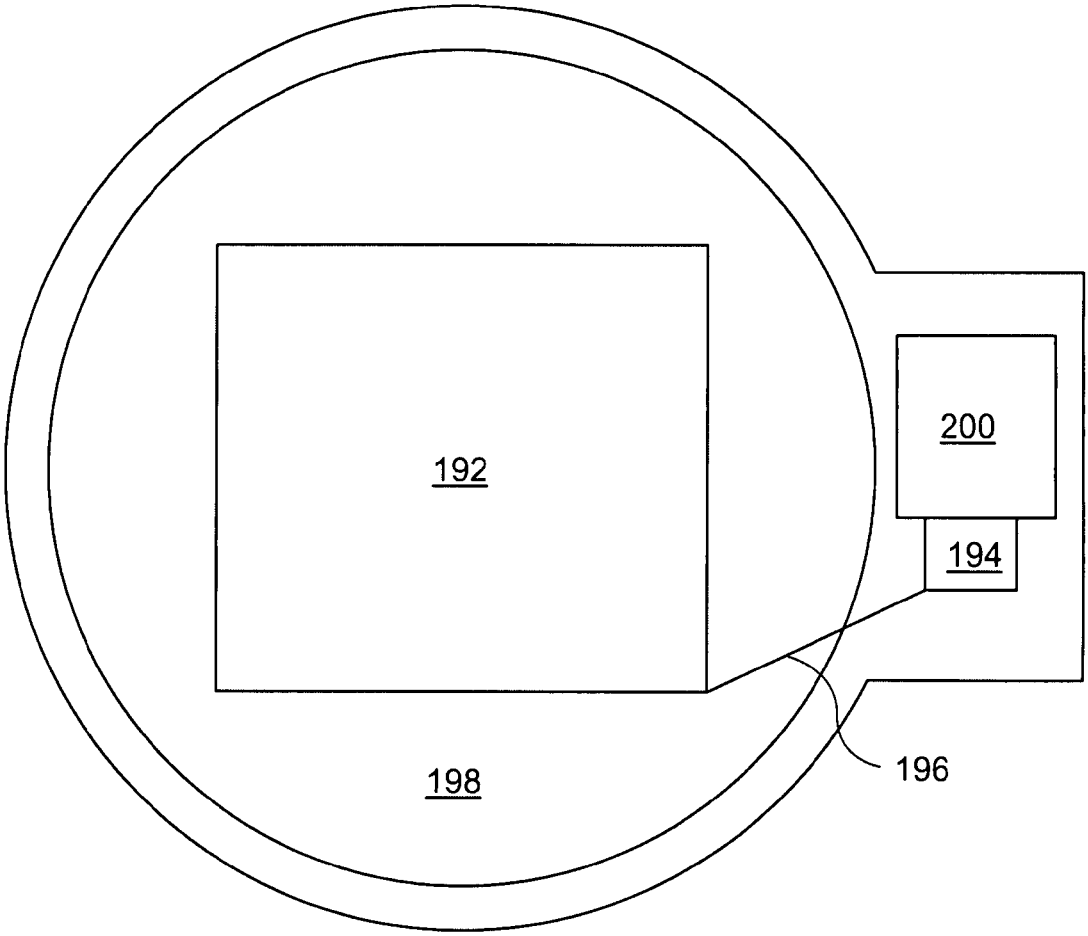
FIG. 13 is a top view of an embodiment of a turntable wrapping apparatus according to an aspect of the invention.

FIG. 13 shows a top view of a load 192, a packaging material dispenser 194 for dispensing a film web 196, and another means for providing relative rotation between the packaging material dispenser 194 and the load 192. The means for providing relative rotation in FIG. 13 includes a rotatable turntable 198. During a wrap cycle, the rotatable turntable 198 will rotate the load 192, while the packaging material dispenser 194 dispenses the film web 196. The packaging material dispenser 194 may also be driven substantially vertically along a column 200. The combination of rotation of the load 192 and vertical movement of the packaging material dispenser 194 may serve to spirally wrap the load 192 with the film web 196.

Figure 14:
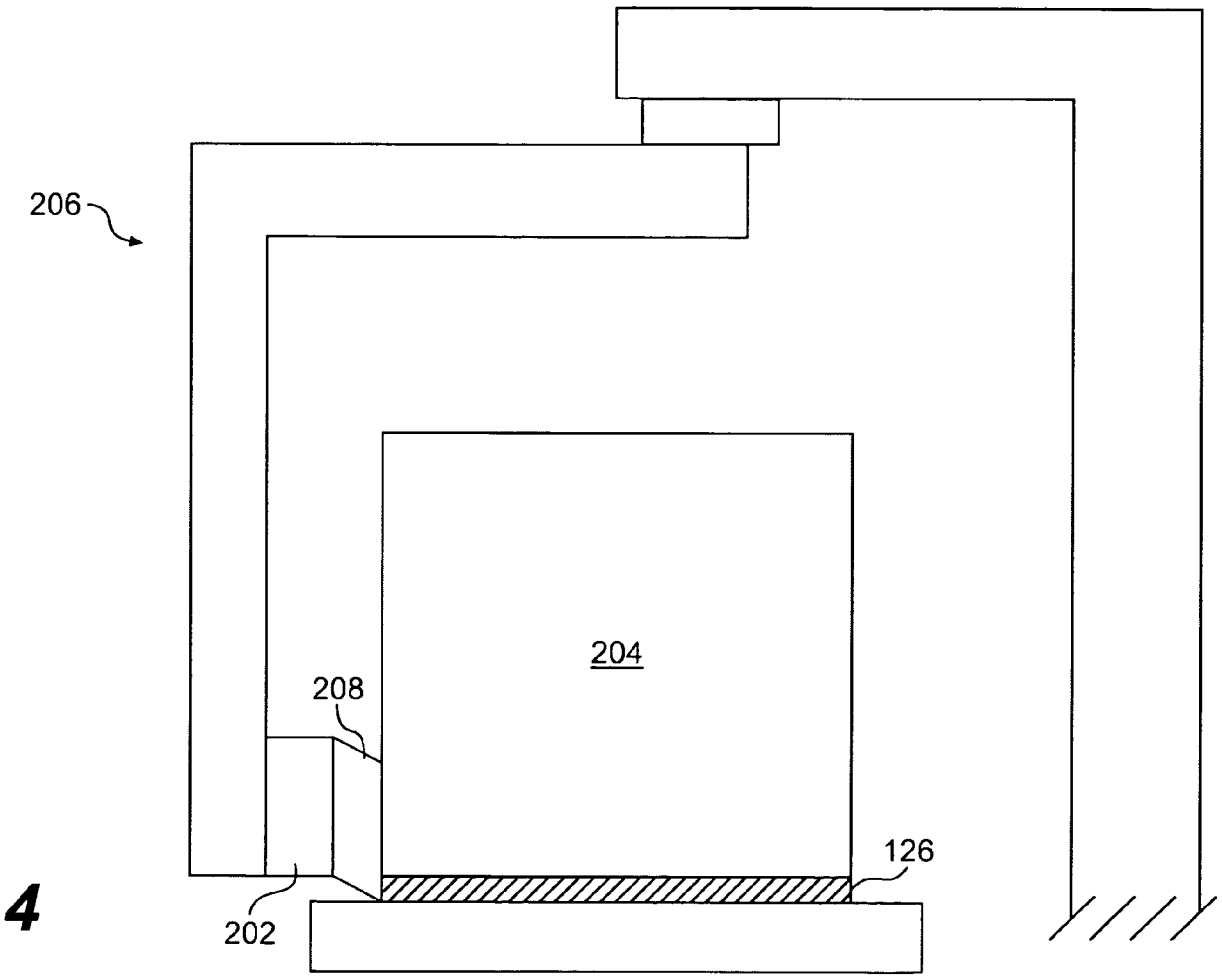
FIG. 14 is a side view of an embodiment of a rotatable arm wrapping apparatus according to an aspect of the invention.

FIG. 14 shows a side view of yet another means for providing relative rotation between a packaging material dispenser 202 and a load 204. In this embodiment, the means for providing relative rotation may include a rotating arm 206 that carries the packaging material dispenser 202 around the load 204. The packaging material dispenser 202 may also move substantially vertically along a vertical portion of the rotating arm 206, to help spirally wrap the film web 208 about the load 204.

The means for providing relative rotation shown in FIGS. 12-14 may be used with any of the packaging material dispensers 10, 70, and 106 of FIGS. 1-8. In other words, the packaging material dispensers 10, 70, and 106 from FIGS. 1-8, may each be used on rotating ring apparatuses, rotating turntable apparatuses, and/or rotating arm apparatuses. Thus, the roping and film drive down abilities of the packaging material dispensers 10, 70, and 106 are not limited by the means for providing relative rotation chosen.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of wrapping a load, comprising:

dispensing a film web from a film dispenser;

providing relative rotation between the load and the film dispenser to wrap the film web around the load;

engaging the film web with a roller, and maintaining engagement of at least a portion of the film web with the roller throughout wrapping of the load;

selectively driving down the engaged portion of the film web with the roller;

roping an edge portion of the film web to form a rope of film; and releasing the roller from driving down the engaged portion of the film web by relative rotation between the load and the film dispenser.

2. A method of wrapping a load, comprising:

dispensing a film web from a film dispenser;

providing relative rotation between the load and the film dispenser to wrap the film web around the load;

continuously engaging the film web with a roller while the film is being dispensed, and moving the roller between:

a first position, wherein the film web leaves the roller at a first elevation substantially equal to an elevation at which the film web was received by the roller, and a second position, wherein the film web leaves the roller at a second elevation different from the first elevation; and roping a portion of the film web into a rope of film;

wherein moving the roller from the second position to the first position includes releasing the roller with a release device by relative rotation between the load and the film dispenser.

3. A method of wrapping a load, comprising:

dispensing a film web from a film dispenser;

providing relative rotation between the load and the film dispenser to wrap the film web around the load;

while dispensing the film web, continuously engaging the film web with a roller, and moving the roller between:

a first position, wherein the longitudinal axis of the roller is substantially perpendicular to a direction of travel of the film web about the roller, and a second position angled relative to the first position, to drive down the film web; and roping a portion of the film web into a rope of film; and releasing the roller from second position by relative rotation between the load and the film dispenser.

* * * * *